US005517799A

United States Patent [19]

Russell et al.

[11] Patent Number: 5,517,799

[45] Date of Patent: May 21, 1996

[54] ONION LOADER/UNLOADER CONVEYOR SYSTEM

[76] Inventors: Donald J. Russell, 30291 Howe Rd., Parma, Id. 83660; Benko S. Ta'ala, 3927 N. 300 W., Provo, Utah 84604

[21] Appl. No.: 278,792

[22] Filed: Jul. 25, 1994

[51] Int. Cl.[6] ..... B65B 25/04; B65B 35/00; B65B 43/42

[52] U.S. Cl. ..... 53/250; 53/244; 53/168

[58] Field of Search ..... 53/250, 249, 251, 53/244, 564, 168, 501; 414/789.9, 788.7, 797.4

[56] References Cited

U.S. PATENT DOCUMENTS

| | | | |
|---|---|---|---|
| 3,853,230 | 12/1974 | Schultz . | |
| 4,600,351 | 7/1986 | Nelson | 53/249 X |
| 4,909,697 | 3/1990 | Bernard, II et al. | 53/251 X |
| 4,974,391 | 12/1990 | Blum et al. | 53/250 X |
| 5,083,411 | 1/1992 | Axmann | 53/251 X |
| 5,325,653 | 7/1994 | Boyd | 53/250 X |

FOREIGN PATENT DOCUMENTS

| | | | |
|---|---|---|---|
| 2302237 | 9/1976 | France | 53/250 |
| 501935 | 4/1976 | U.S.S.R. | 53/250 |

*Primary Examiner*—James F. Coan

[57] ABSTRACT

A loading/unloading conveyor system used for transfer of onions into onion crates and the subsequent handling of onion crates. The system comprises a multiple collection scoop for transfer of onions from the field to conveyors, an unloading head which fills the onion crates and cushions the onions as they enter the empty crates, a hoist from which empty crates are continuously supplied, a conveyor for holding empty crates, a hoist for stacking full crates, and a conveyor for holding full crates. Empty crates are constantly supplied to the empty crate conveyor as they enter the system. The empty crate conveyor in turn supplies the empty crate hoist which controls the release of a single crate into the system at a time. The individual empty crates are led by conveyor to the unloading head wherein they are filled with onions without bruising. The full onion crates then progress to the stacking hoist which stacks full onion crates two high. Stacked crates are then advanced to a holding conveyor to await transportation by forklift to a designated storage area.

12 Claims, 31 Drawing Sheets

6

ONION LOADER/UNLOADER CONVEYOR SYSTEM

FIELD OF THE INVENTION

The invention generally pertains to the transport of onions into storage sheds, and, more specifically, to the transfer process of onions from unloading trucks to onion crates.

DESCRIPTION OF RELATED ART

During onion harvest time, onions are brought to large storage sheds to await packaging and other processes as the packaging companies deem necessary. Several machines exist to aid in the harvesting process such as an onion harvester machine disclosed in U.S. Pat. No. 3,449,132, or an onion topper as disclosed in U.S. Pat. No. 5,197,549. However, no patented machine exists for the purpose of efficiently transferring onions from trucks returning from the field with a full load of onions, to storage crates, and into storage. U.S. Pat. No. 3,853,230 discloses a loader/unloader conveyor system but is of substantially different design and application. The method currently deployed for transferring onions to crates and subsequently to a storage area involves forklifts and a conveyor system. Trucks are backed up to a single unloading collection scoop which feeds the onions onto a conveyor. Trucks are often backed up in lines due to several factors attributing to the inefficiency of the existing process, one of which is the time it takes for a driver to maneuver his truck into place. The bad onions are weeded out by workers as they move down the said conveyor. At the end of the conveyor is a heavy, cumbersome, manually operated damper to cushion the onions as they fall from the said conveyors into large storage crates. When no damper mechanism exists, a flat board is used held by a worker, and manually retracted when sufficient onions accumulate in the crate floor. The worker is engulfed in dust as he or she manipulates the heavy damper or board. Crates being filled are moved along by a second conveyor, hereafter referred to as crate conveyor, as it is activated by the worker operating the damper. Empty crates are replenished from a single stack of four crates at one end of the crate conveyor. The stack is generated by a forklift and forklift operator. A second forklift is stationed permanently with the stack and repetitively releases an empty crate from the stack as the conveyor is activated. This is accomplished by the forklift raising all crates except the bottom one which then moves along the activated crate conveyor. The forklift then lowers all the crates onto the crate conveyor, adjusts to the new height immediately above the lowest crate which is now sitting on the crate conveyor, lifts the stack releasing another crate to be filled.

After the crates are filled, they progress to a stacking stage. At this point, another forklift and forklift operator is permanently stationed whose sole purpose is to stack the full crates on top of each other to a maximum of two high. After said full crates are stacked, a final forklift picks up the said stacked crates and transports them to the nearby storage area.

The operation is often bottle-necked at four locations: the unloading collection scoop, the unloading damper head, the empty crate stacking and releasing forklifts, and the full crate stacking and transport forklifts.

The one-piece crate conveyor is also overloaded with multiple tasks and thus, its single motor often fails.

SUMMARY OF THE INVENTION

To avoid the limitations and problems with present methods, an object of the invention is to eliminate bottle-necks at the unloading collection scoop. A further object of the invention is to automate the unloading damper head. A still further object of the invention is to eliminate the forklift and its operator which repetitively releases an empty crate from the empty crate stack. A still further object of the invention is the automation of the conveyor system to enable it to run without an operator. The single operator located at the unloading damper head has control to intervene the operation, and/or monitor the speed of the system.

The invention has purposely avoided the use of pneumatics and hydraulics because of the adverse effects of corrosion and the presence of dust in pneumatic lines, and the need for adequate speed, a criteria lacking in hydraulic systems. Hydraulic systems also rely on pneumatics for its control system. The invention has utilized electro-mechanical means to achieve corrosion resistance and adequate speed.

These and other objects of the invention are provided by a novel multi-head unloading collection scoop. The three, but not limited to three, collection scoops individually feed a single conveyor as each said scoop is activated. The single conveyor directs and carries onions to a novel automated unloading damper head which fills empty crates while preventing onion skins from being broken as they impact the empty crate flooring. The unloading damper head is an electronically controlled mechanical head operated by a worker from a safe distance. The stationary forklift operations at the empty crate stack and at the full crate end of the crate conveyor is accomplished by a novel hoist apparatus mechanically operated on a cable-drum system as more fully described in the preferred embodiment of the invention. The crate conveyor system consists of five independently automated conveyors with strategic use and placement of electronic photo-sensors and limit switches.

Timing of every component is essential to the smooth operation of this invention. Motors, gear boxes, sprockets and like devices and novel concepts embodying the invention have been designed to enable the invention to overcome limitations of previous methods. These and other features and advantages of the present invention will become more fully apparent through the following description and appended claims taken in conjunction with the accompanying drawings.

BRIEF DESCRIPTION OF DRAWINGS

In order that the manner in which the above-recited and other advantages and features of the invention are obtained, a more particular description of the invention summarized above will be rendered by reference to the appended drawings. Understanding that these drawings only provide a selected embodiment of the invention and are not therefore to be considered limiting of its scope, the invention will be described and explained with additional specificity and detail through the use of the accompanying drawings in which.

DESCRIPTION OF THE PREFERRED EMBODIMENT

Figure 1:
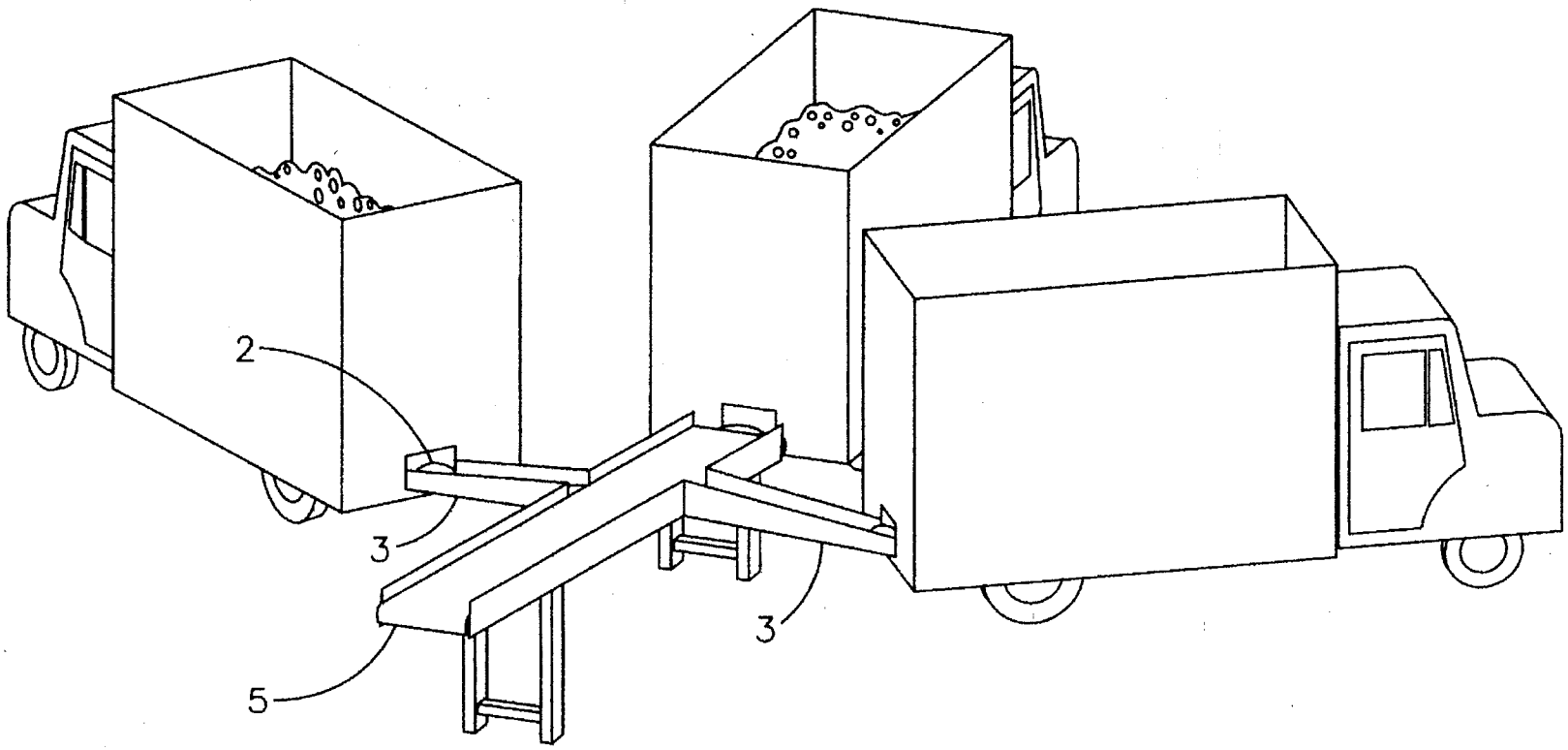
FIG. 1 is a perspective view of the multiple unloading collection scoop made in accordance with this invention.

Reference is now made to the figures wherein like parts are referred to by like numerals. Unloading onion trucks are backed up to a multi-head collection scoop generally designated at 1 in FIG. 1. The multi-head collection scoop 1 includes a scoop 2 which accumulate onions from unloading trucks and dispel them onto sub-conveyor 3. The quantity of scoop 2 and sub-conveyor 3 is only limited by the number of unloading trucks which can comfortably operate in a given area. Sub-conveyor 3 in turn feeds main conveyor 5 wherein bad onions are weeded out by workers who stand alongside said conveyor 5. Control of onion entry to main conveyor 5 is accomplished by an on-off switch which turns off conveyors on trucks such that a single sub-conveyor 3 is operating at a time.

Figure 2:
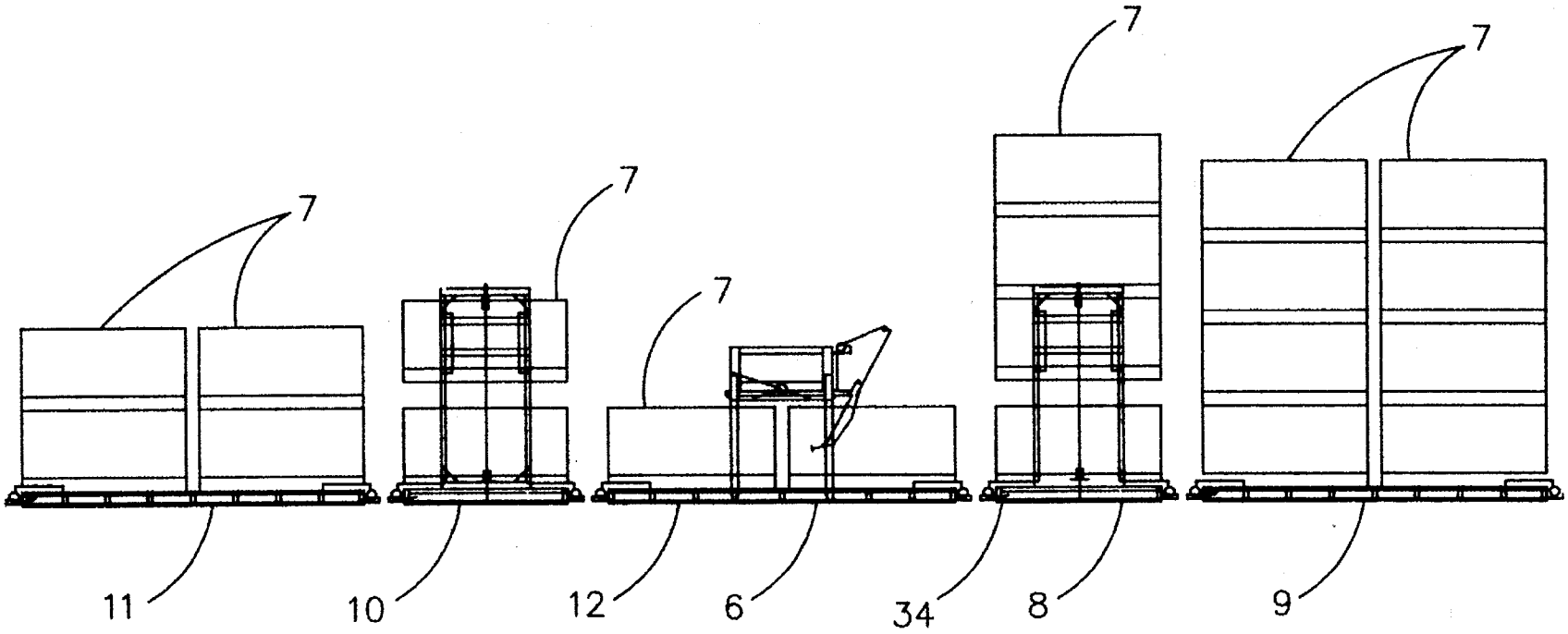
FIG. 2 is a rear view of the system made in accordance with this invention.
Figure 4:
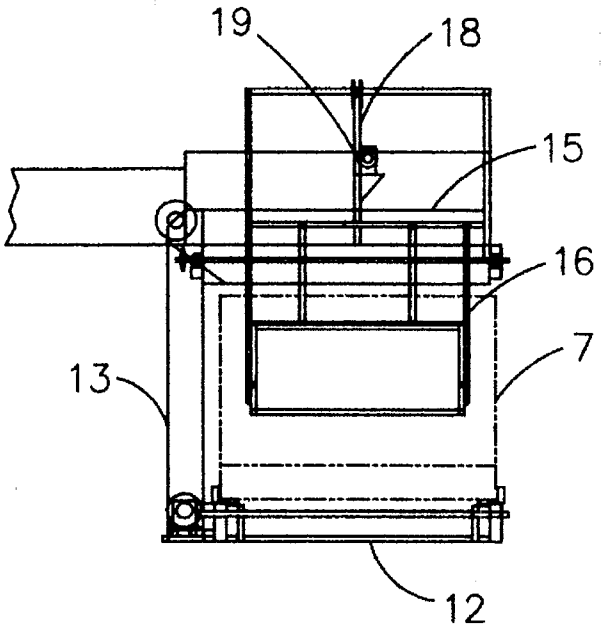
FIG. 4 is a side view of FIG. 3.
Figure 3:
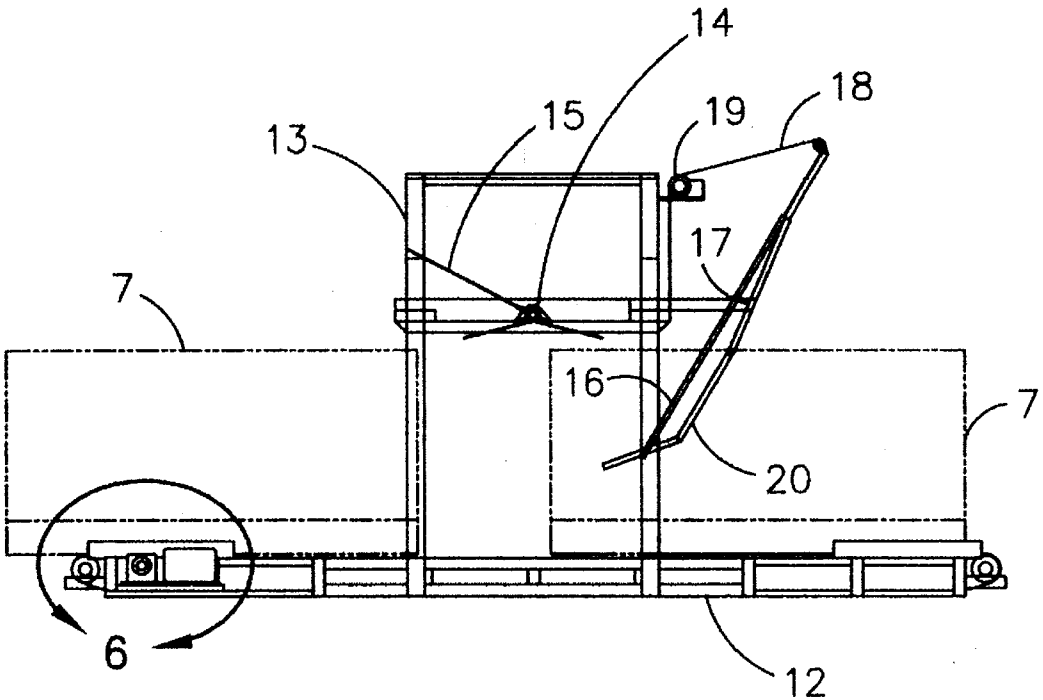
FIG. 3 is a detail view of general element 6 of FIG. 2 as viewed from the rear.

Main conveyor 5 feeds the unloading damper head generally designated at 6 in FIG. 2. The unloading damper head 6 locates an empty crate 7 in position to be filled. Said empty crate 7 is supplied from the empty crate hoist designated at 8. Empty crate hoist 8 releases a single empty crate 7 as it is prompted by crate conveyor 12. Empty crate hoist 8 is replenished with empty crates from crate conveyor designated at 9.

Once crates are full at unloading damper head 6, they are moved to the full crate hoist designated at 10. Here, full onion crates are stacked on top of each other at a maximum of two high which height is only limited by full crate hoist 10 and forklift capacity, and transferred to crate conveyor designated at 11 to await transportation to storage area.

The unloading damper head generally designated 6 as shown in FIG. 3 through 8, consists of a crate conveyor 12 which allows crate 7 to move at a constant speed, and is attached to frame stand 13. Frame stand 13 supports a substantially large enclosure which houses a diverter dam 15, said dam pivoting about shaft 14. Egress of onions at a given end is controlled by diverter dam 15 as it pivots about shaft 14. Also attached to frame 13 is a vertical mobile damper assembly 16 which is aligned and controlled in its vertical motion by sliding within linear bearings 17 attached to frame 13. Damper assembly 16 is elevated and lowered by cable 18 and cable drum 19 which is powered by a motor not shown. Frame work of damper assembly 16 is comprised of a rubber pad 20 which dampens the fall of onions as they exit said enclosure and fall into crate 7. Damper assembly 16 is activated in its vertical motion by diverter dam 15 or by moving crate 7 tripping a limit switch in its path of travel, such that constantly moving crate 7 will not collide with damper assembly 16.

Figure 7:
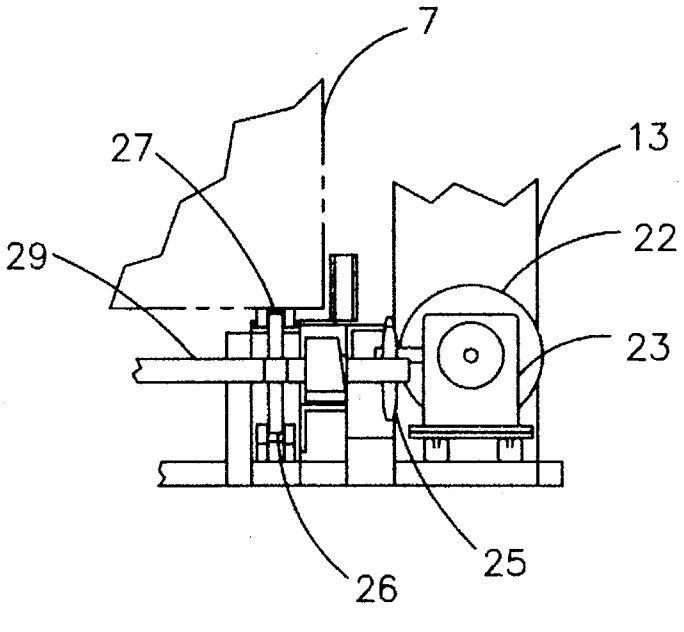
FIG. 7 is View 7—7 of FIG. 6
Figure 6:
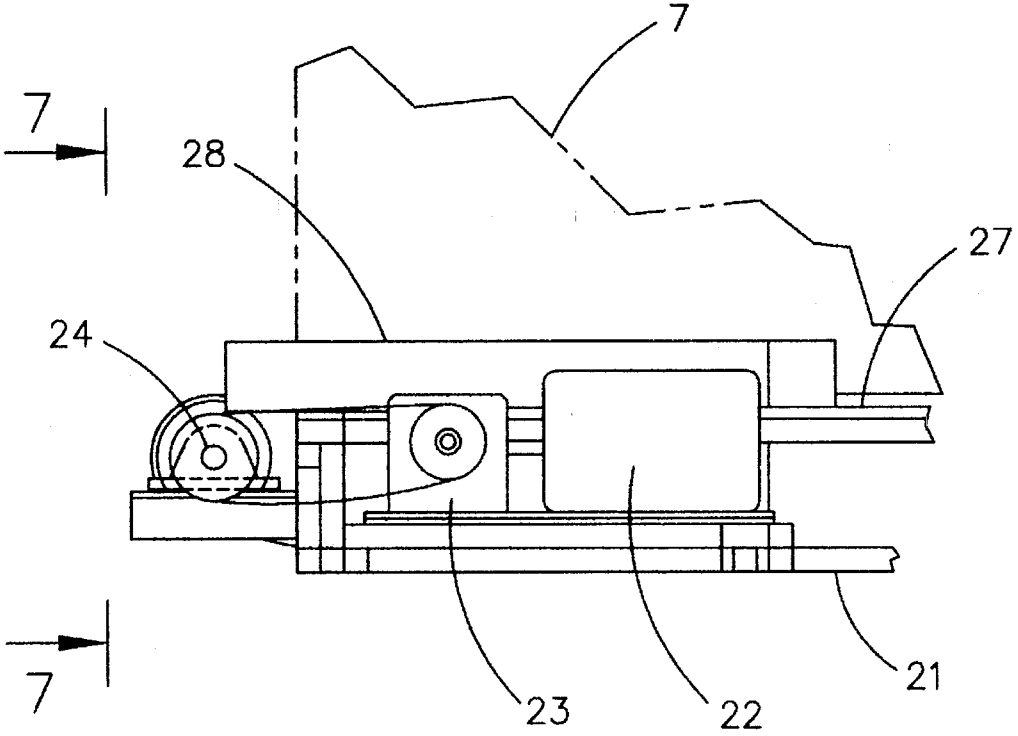
FIG. 6 is View 6 of FIG. 3.
Figure 8:
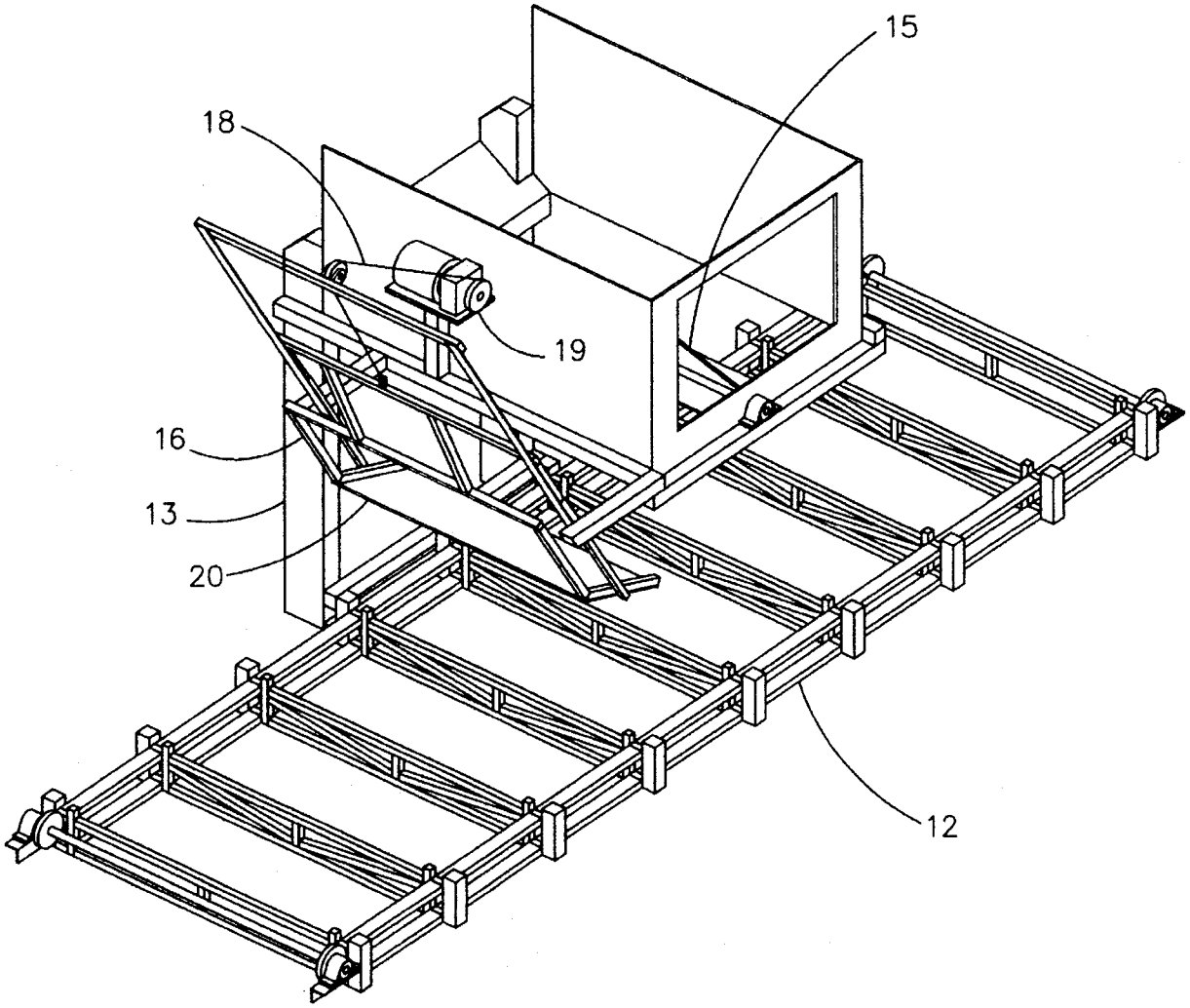
FIG. 8 is a perspective view of FIG. 3.

Crate conveyor 12 as depicted in FIGS. 6 and 7 consists of framework 21 which supports a motor not shown, gear box 23, pillow block bearing 24, and accompanying chain sprockets 25 and conveyor sprockets 26. Conveyor chain 27 carries crate 7 as it is driven by conveyor sprocket 26. Angle 28 guides and aligns crate 7 during its movement. FIGS. 6 and 7 are typical at all four comers of crate conveyor 12 less motor 22, gear box 23, and chain sprocket 25. Sprocket 26 located at the four corners of said conveyor 12, are synchronized by round bar 29 and conveyor chain 27.

Figure 9:
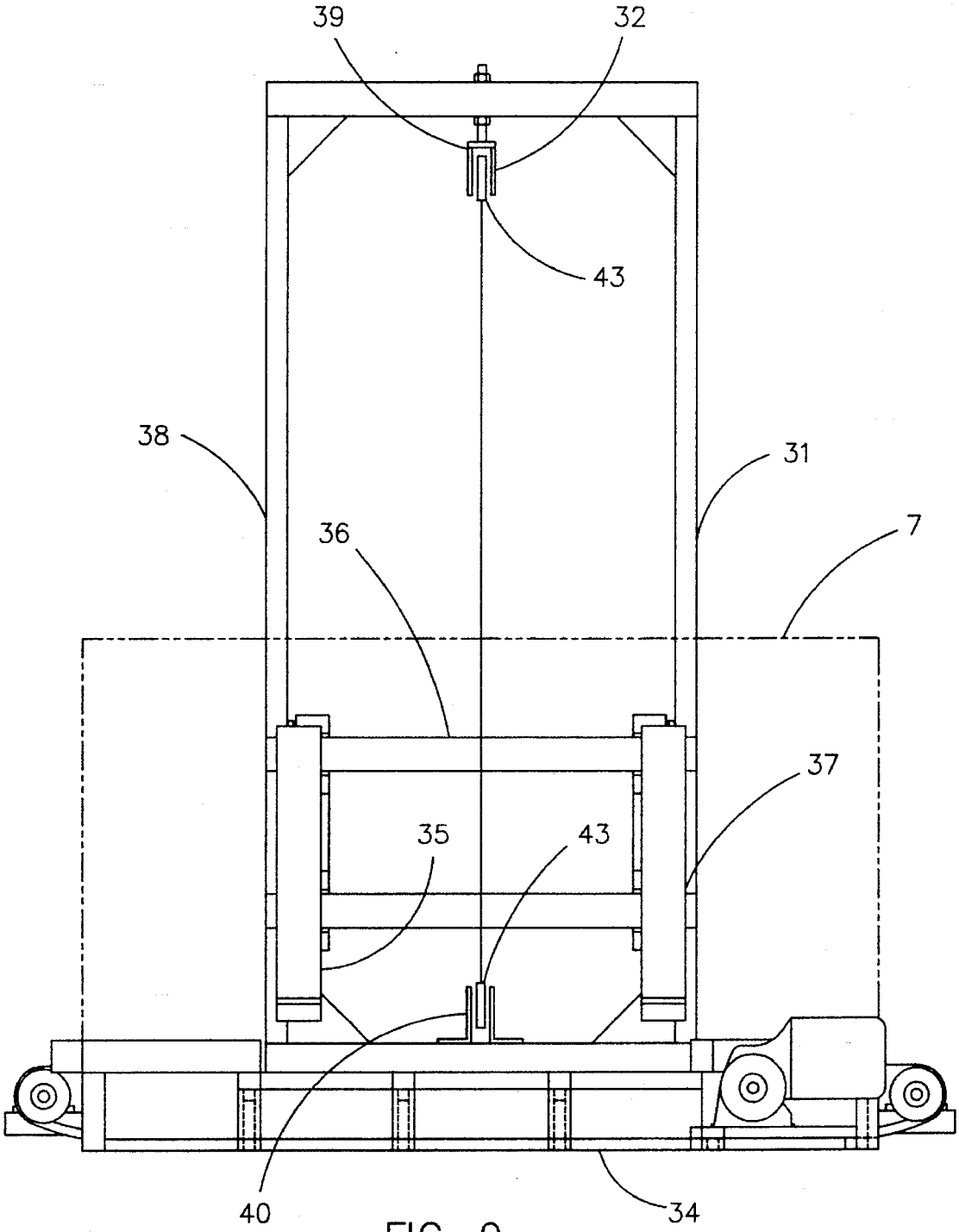
FIG. 9 is a detail view of general element 8 of FIG. 2 as viewed from the rear.
Figure 10:
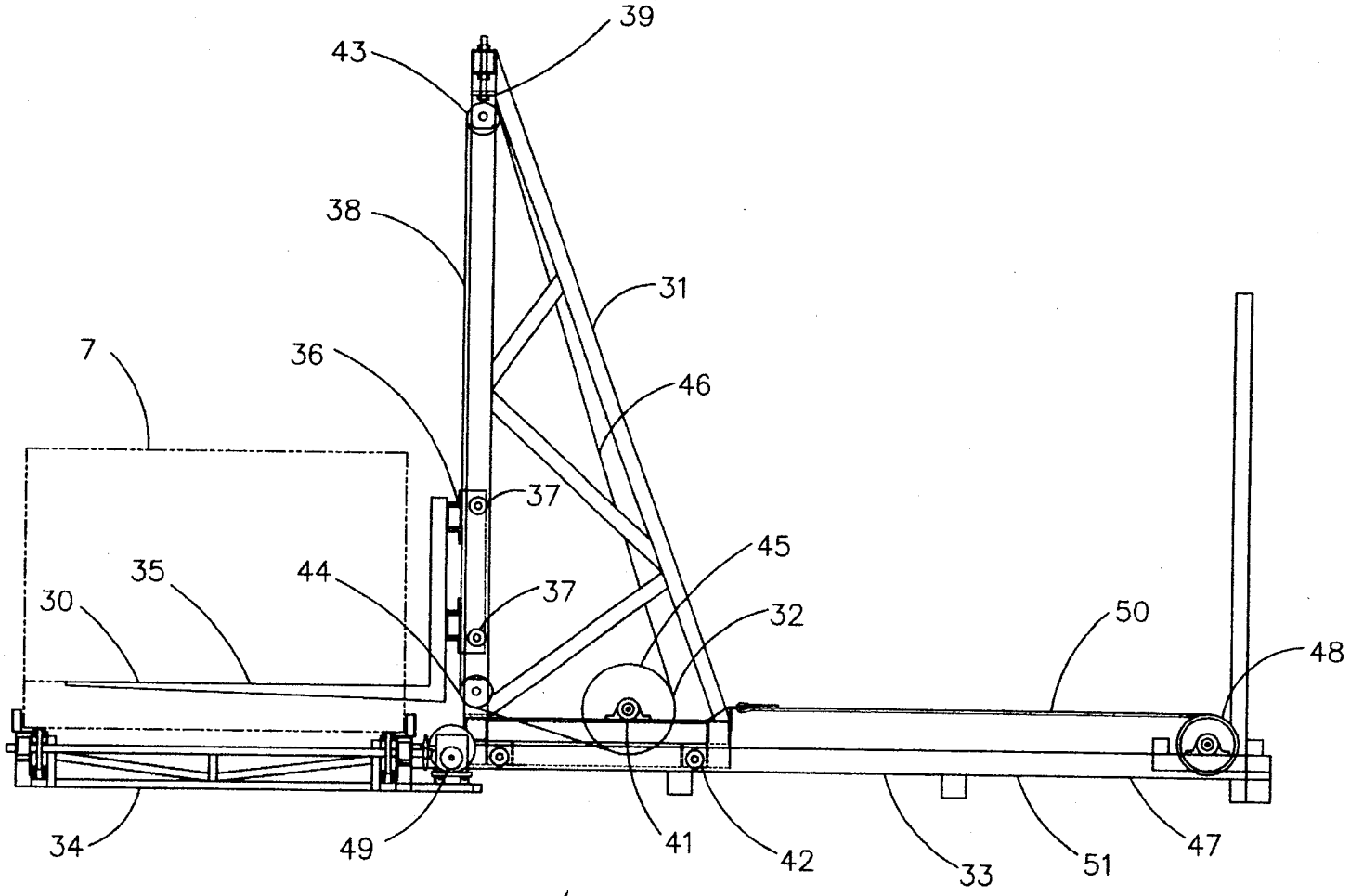
FIG. 10 is a side view of the device of FIG. 9 in the forward and up position.

Empty crate hoist 8 as shown in FIGS. 9 and 10, is comprised of fork assembly 30, carriage assembly 31, cable assembly 32, carriage support frame 33, and crate conveyor 34. Fork assembly 30 consists of two forks 35, support frame 36, and four attachment cam rollers 37. Carriage assembly 31 consists of channel 38 within which cam roller 37 of fork assembly 30 rolls. This enables fork assembly 30 to glide freely vertically, elevating crate 7 as required. The remaining framework of carriage assembly 31 provide structural stability, mounting bracket 39, 40, and 41 for cable assembly 32, and four cam rollers 42 which allows carriage assembly 31 to move horizontally.

Cable assembly 32 is comprised of sheave 43, sheave 44, cable drum 45, and cable 46. Said cable 46 is a continuous loop, wrapping around cable drum 32 several times in order to provide sufficient cable for the vertical stroke of fork assembly 30. Fork assembly 30 is thus attached to cable 46, and the resulting vertical motion is driven by a motor not shown attached to cable drum 32.

Carriage support frame 33 is comprised of framework 47, cable drum 48, sheave 49, and cable 50. Said cable 50 is attached to carriage assembly 31, and wraps around cable drum 48 several times to provide sufficient cable for the horizontal stroke of carriage assembly 31. The resulting horizontal motion of carriage assembly 31 is driven by a motor not shown attached to cable drum 48. Principle to framework 47 are two channels 51 within which cam roller 42 of carriage assembly 31 rolls. Channel 51 is also attached to crate conveyor 34 thus unifying general element 8, the empty crate hoist.

Said crate conveyor 34 is identical to crate conveyor 12 shown in FIGS. 6 and 7, except that it is substantially shorter since it only carries a single crate 7 as shown in FIG. 9 and FIG. 2, and sprocket sizing to control the speed of crate 7 is of substantially different ratios since the desired speed for crate 7 is substantially different from that at crate conveyor 12.

Figure 11:
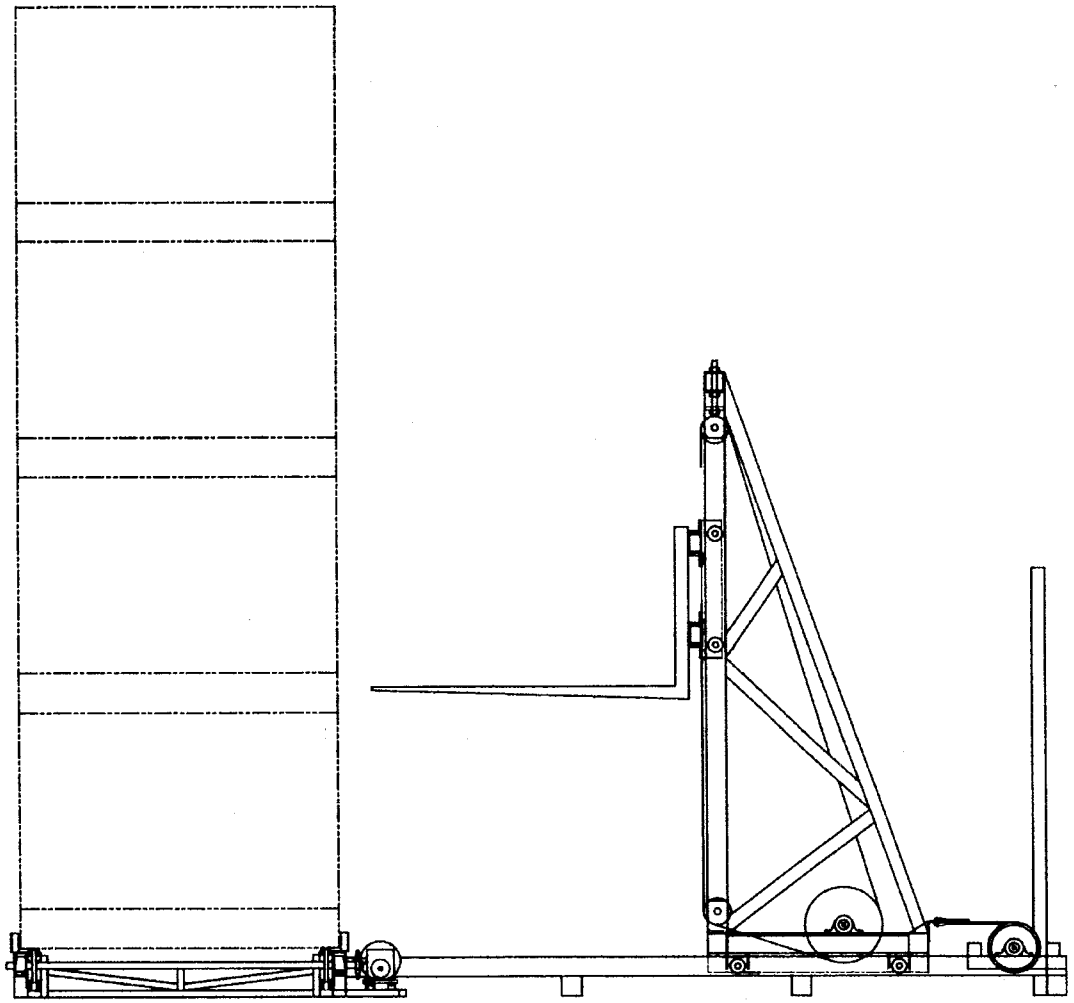
FIGS. 11 through 13 are different positions during operation of device of FIG. 9.
Figure 12:
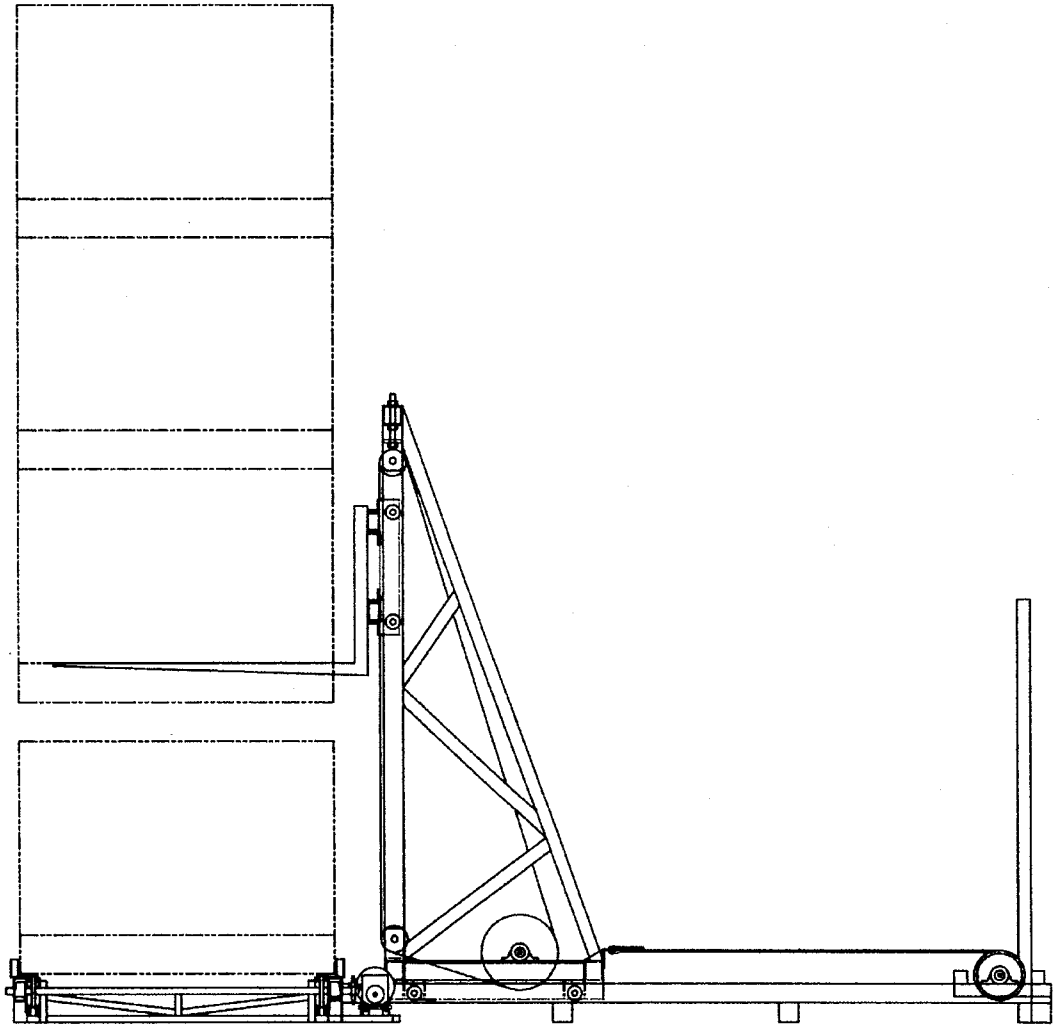
Figure 13:
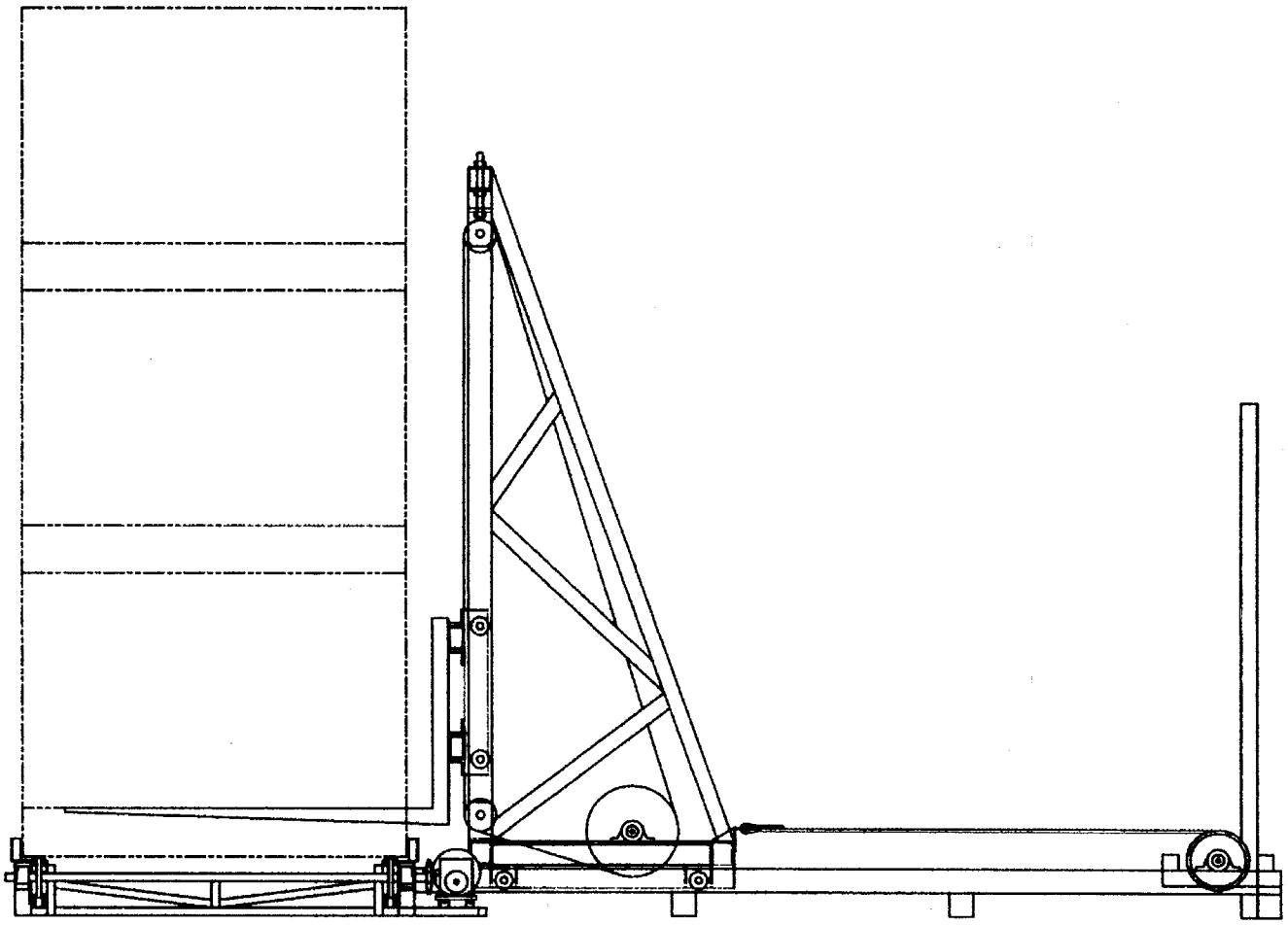
Figure 14:
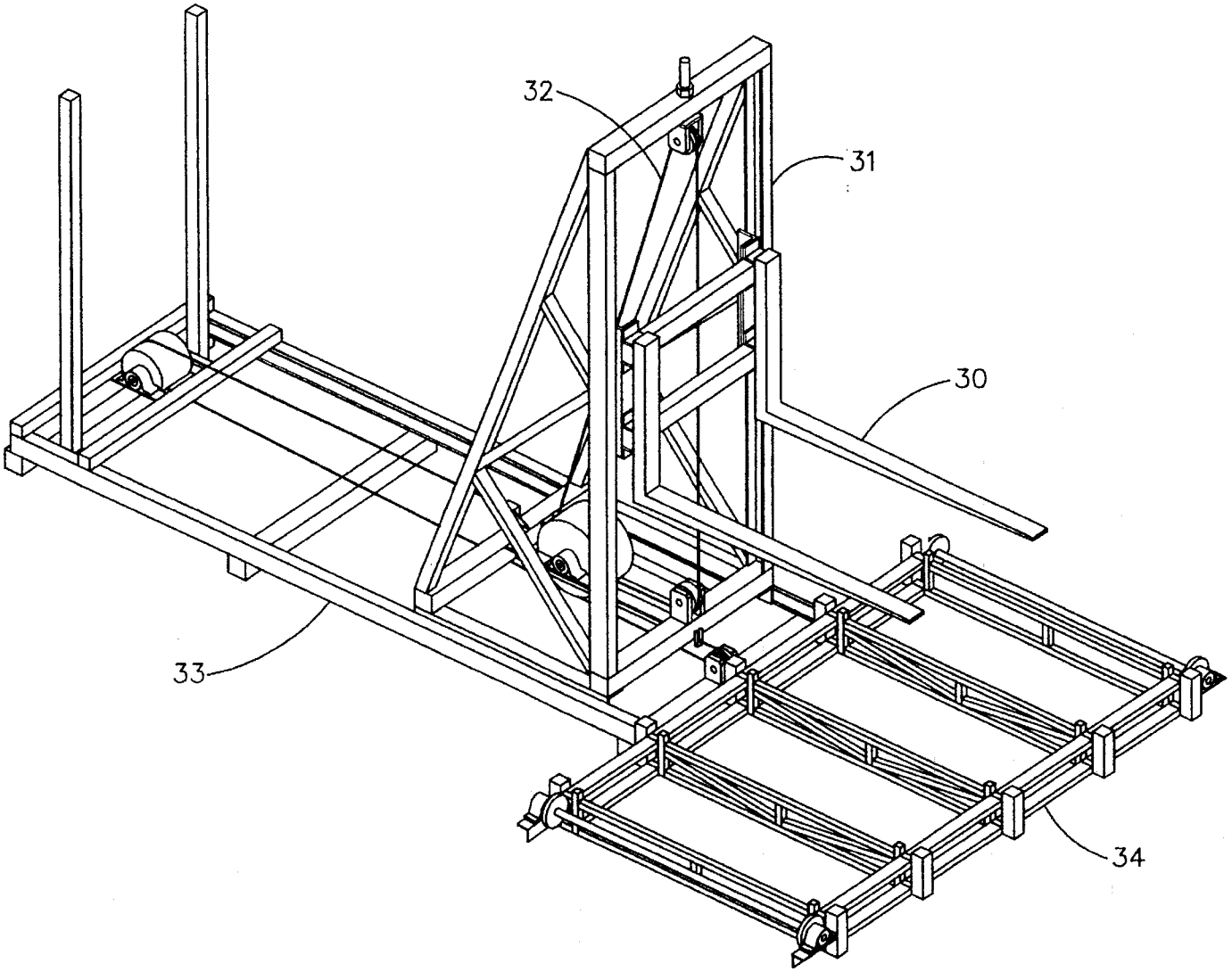
FIG. 14 is a perspective view of FIG. 9.

The sequence of how the empty crate hoist 8 operates is shown in FIGS. 11 through 13. A set of four empty crates 7 is transferred onto crate conveyor 34 with carriage assembly 31 in the back and mid position as shown in FIG. 11. Carriage assembly 31 moves forward and picks up three crates 7 leaving one behind which is then allowed to advance to the next operation at general element 6, the unloading damper head, as permitted by crate conveyor 12 and crate conveyor 34 as shown in FIG. 12. Carriage assembly 31 lowers the three crates onto crate conveyor 34 as shown in FIG. 13, backs out and elevates fork assembly 30 in the ready position of FIG. 11 to repeat the operation. Empty crate hoist 8 is shown in perspective view at FIG. 14.

Empty crates are fed to general element 8 by crate conveyor designated at 9 of FIG. 2. Crate conveyor 9 is identical to crate conveyor 12 of general element 6 of FIG. 2 except that it is free standing, unlike crate conveyor 12 which is attached to frame stand 13 of general element 6, and also the sprocket sizing to control the speed of crate 7 movement is of substantially different ratio since the desired speed for crate 7 is substantially different from that at crate conveyor 12.

After crates 7 are filled with onions at the unloading damper head 6 of FIG. 2, they are advanced to full crate hoist designated at 10 of said FIG. 2. Full crate hoist 10 is identical to empty crate hoist 8 except for substantial differences in motor, gear, and sprocket sizing to account for the speed of the crate conveyor and the added weight of onions. Full crate hoist 10 lifts a single full crate 7 and stacks it on another full crate 7 which passes and awaits under it. Filled and stacked crates 7 are then advanced to crate conveyor generally designated at 11 in FIG. 2 to await forklift transportation to storage area. Crate conveyor 11 allows two sets (but not limited to two) of stacked fully loaded crates 7 to await forklift operation.

Figure 15:
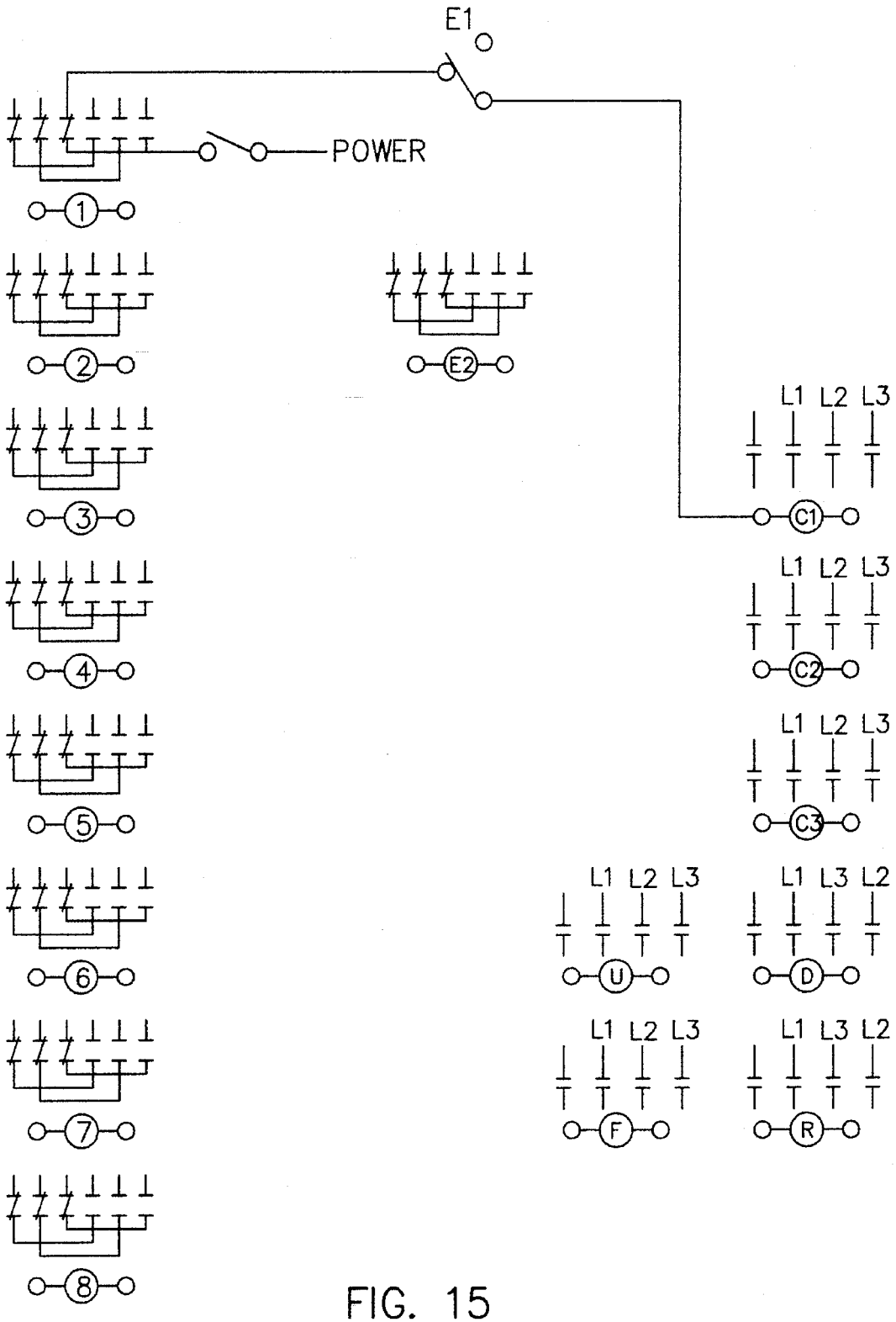
FIGS. 15 and 16 are the electronic control schematic of general element 9 of FIG. 2.

The electronic control system that allows the foregoing operation to perform harmoniously is described in the remainder of this section starting with crate conveyor 9:

Crate conveyor 9 control works in two ways. As shown in FIG. 15, when the power is turned on, crate conveyor 9 will run for thirty seconds. If eye #1 (E1) does not see a crate during this thirty seconds, it will shut down said conveyor 9. When a crate is put on crate conveyor 9 and eye #1 sees it, it will start conveyor 9 in thirty seconds. Power comes from limit switch #1 (1) normally closed contact, to eye #1 normally closed contact, and then to the coil (C1) of crate conveyor 9 magnetic starter. If eye #1 sees a crate, conveyor 9 will run until limit switch #1 is tripped. This will put crates on the right side of conveyor 9 as seen from the front.

Figure 16:
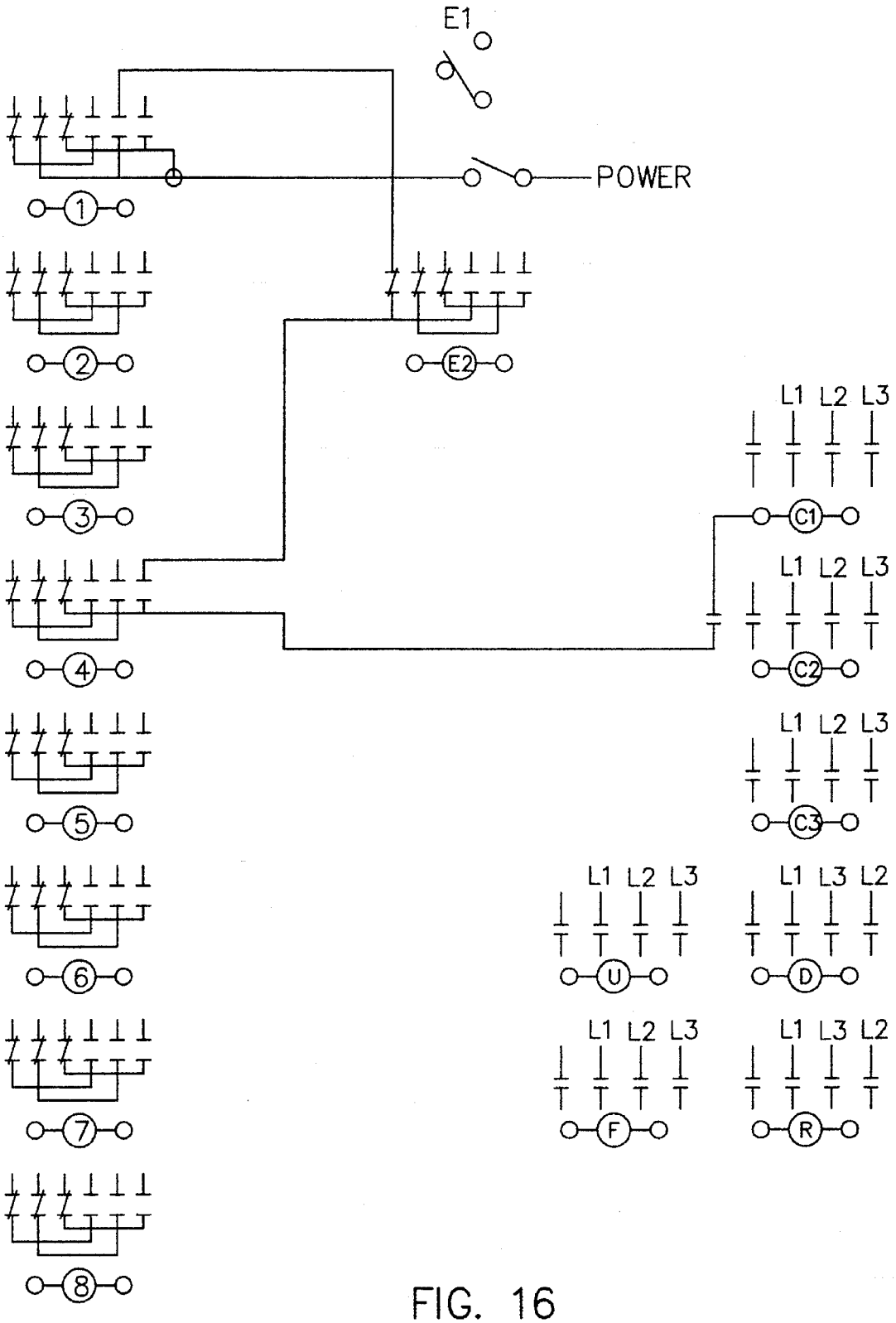

Crate conveyor 34 of general element 8 in FIG. 2 can also run crate conveyor 9 if there are no boxes on it as shown in FIG. 16. Power starts at limit switch #1 normally open contact, goes to eye #2 (E2) normally closed contact, then to limit switch #4, then to the normally open contact of crate conveyor 34 magnetic starter, and then to the coil (C1) of crate conveyor 9 magnetic starter.

Figure 17:
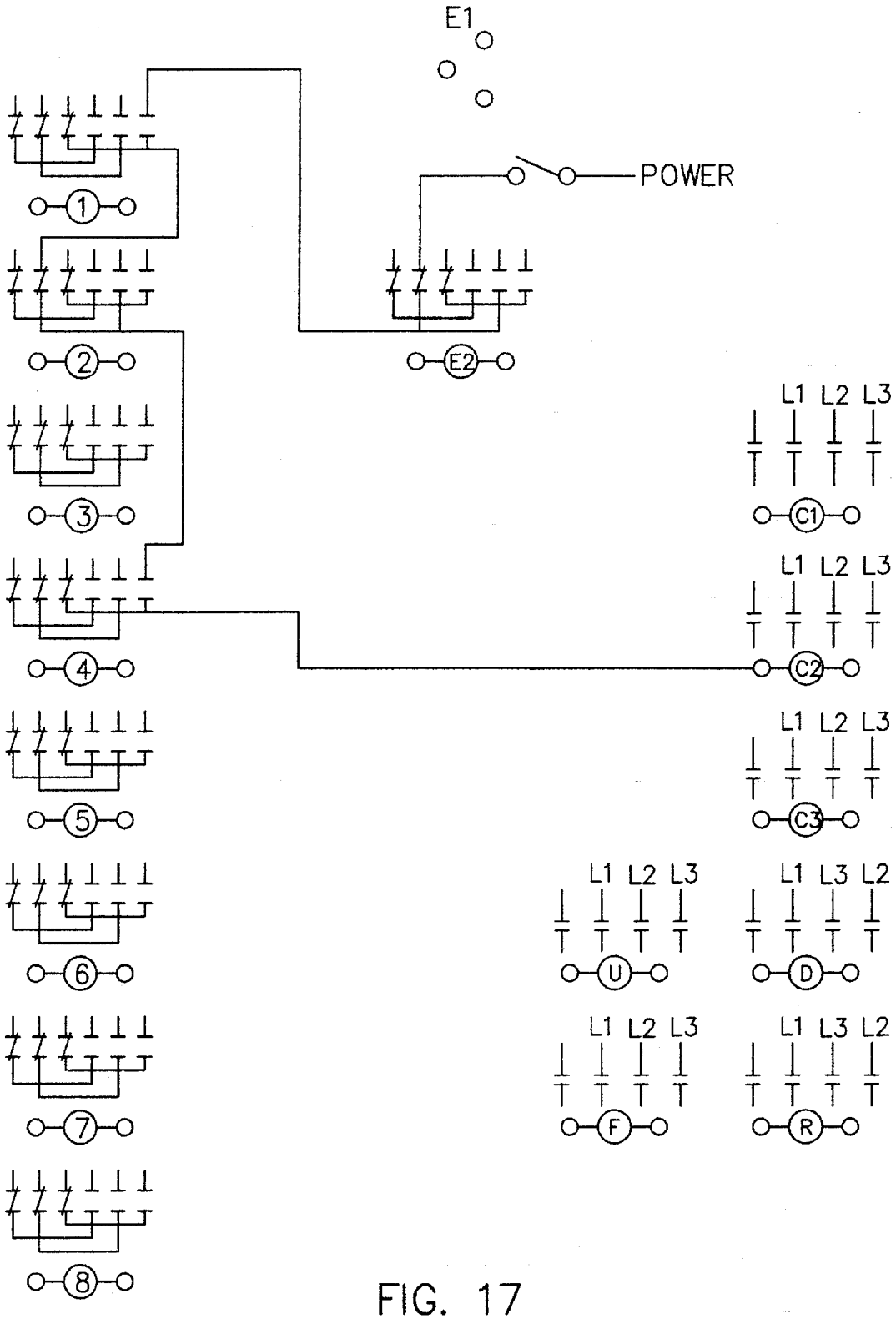
FIGS. 17 and 18 are the electronic control schematic of general element 34 of FIG. 2.

Electronic control for crate conveyor 34 of general element 8 in FIG. 2 also works in two ways. First as shown in FIG. 17, when crates 7 are needed from conveyor 9, power starts at eye #2 (E2) and goes through a normally closed contact to limit switch #1 normally open contact, then to limit switch #2 (2) normally dosed contact, then to limit switch #4 (4) normally open contact, and finally to the coil (C2) on conveyor 34 magnetic starter. If eye #2 does not see any crates, the normally closed contact is closed and power goes through eye #2 to limit switch #1. If there are crates on crate conveyor 9, they will trip limit switch #1 closing the normally open contact, thus permitting power to go to limit switch #2. With no crates on conveyor 34, limit switch #2 is not tripped. The normally closed contact is closed, letting power go to limit switch #4. Carriage 31 of general element 8 must be all the way back and limit switch #4 must be tripped and the normally open contact closed, before power will go to the coil (C2) on conveyor 34 magnetic starter.

Figure 18:
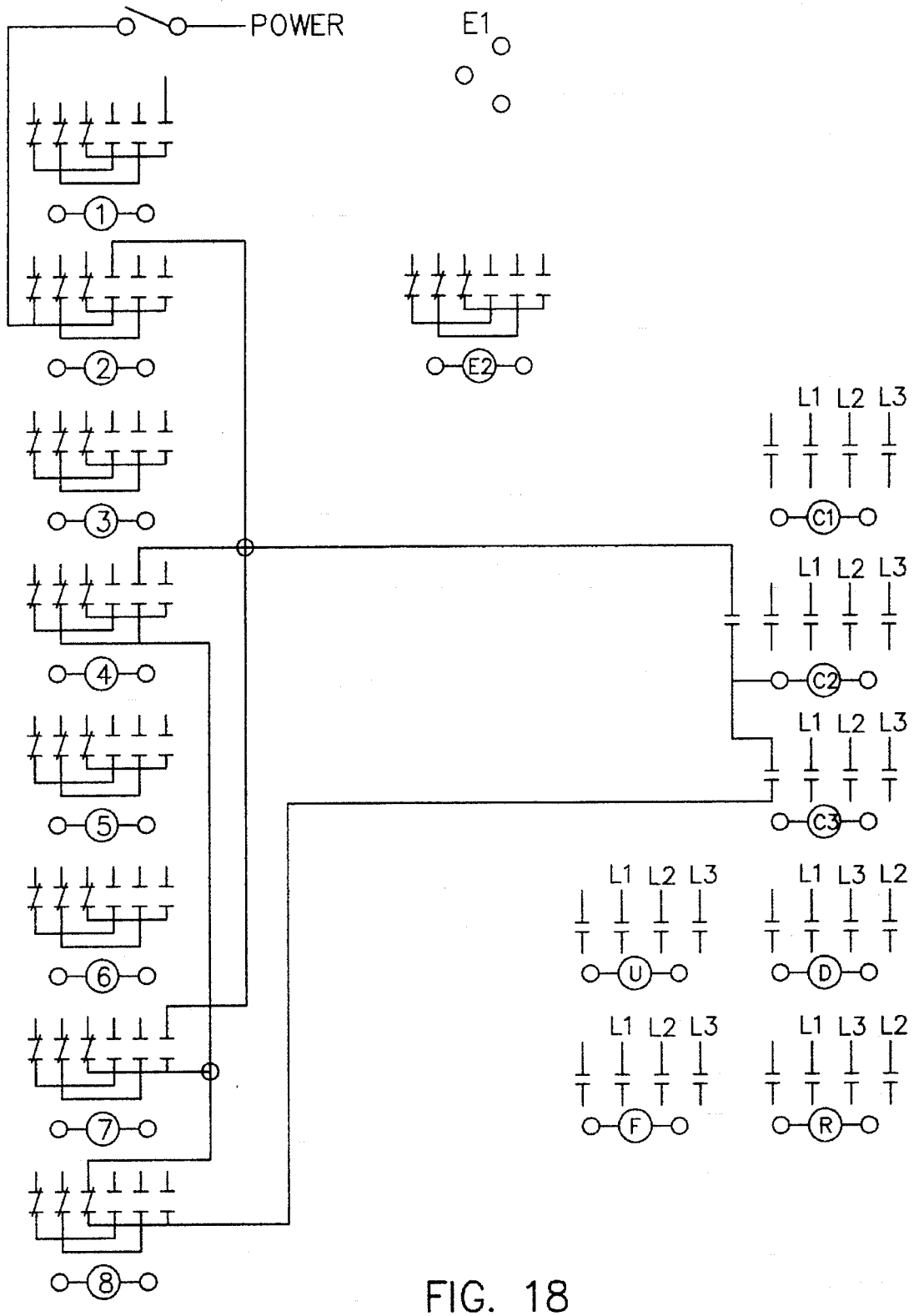

Secondly as shown in FIG. 18, when crate conveyor 12 of general element 6 needs a crate, power starts at limit switch #2, goes through a normally open contact to a normally open contact on crate conveyor 34 magnetic starter coil (C2), and to a normally open contact on limit switch #4 and a normally open contact on limit switch #7 (7). From the normally open contact on limit switch #4 (LMS4) or the normally open contact on limit switch #7 (LMS7) to a normally closed contact on limit switch #8 (8), then to a normally open contact on crate conveyor 12 magnetic starter (C3), and then to crate conveyor 34 starter coil (C2).

With crates on crate conveyor 34 tripping limit switch #2, the normally open contact is closed, letting power go to a holding contact on conveyor 34 magnetic starter coil (C2). The power also goes from limit switch #2 to limit switch #4 and limit switch #7. In this way, if carriage assembly 31 is back tripping limit switch #4, or if the fork assembly 35 is up tripping limit switch #7, either one will let power go to limit switch #8. With limit switch #8 not tripped, the normally closed contact is closed letting power go to a normally open contact on conveyor 12 magnetic starter coil (C3). Conveyor 12 must be running and the normally open contact closed before power can access the coil on conveyor 34 magnetic starter.

Figure 19:
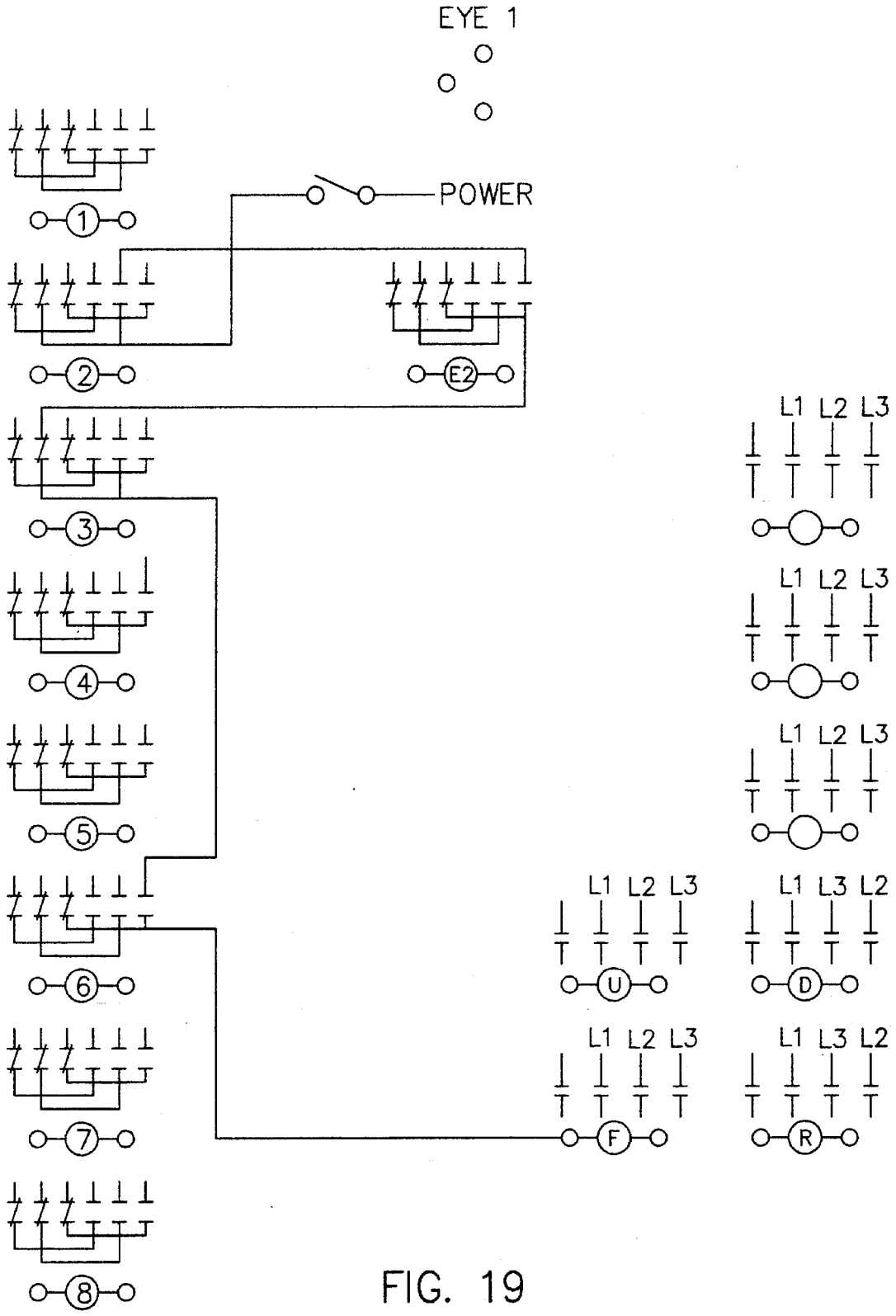
FIGS. 19 through 23 are the electronic control schematic of general element 8 of FIG. 2.

Empty crate hoist 8 is electronically controlled five ways. From starting point forward to limit switch #3 (3), up to limit switch #7 (7), down to limit switch #5 (5), reverse to limit switch #4 (4), and up to limit switch #6 (6). Forward movement is depicted in FIG. 19 wherein power starts at limit switch #2 normally open contact, then to a normally open photo-sensing eye (E2), then proceeds to limit switch #3 normally closed contact, then to limit switch #6 normally open contact, and finally to coil (F) on the forward magnetic starter.

Figure 20:
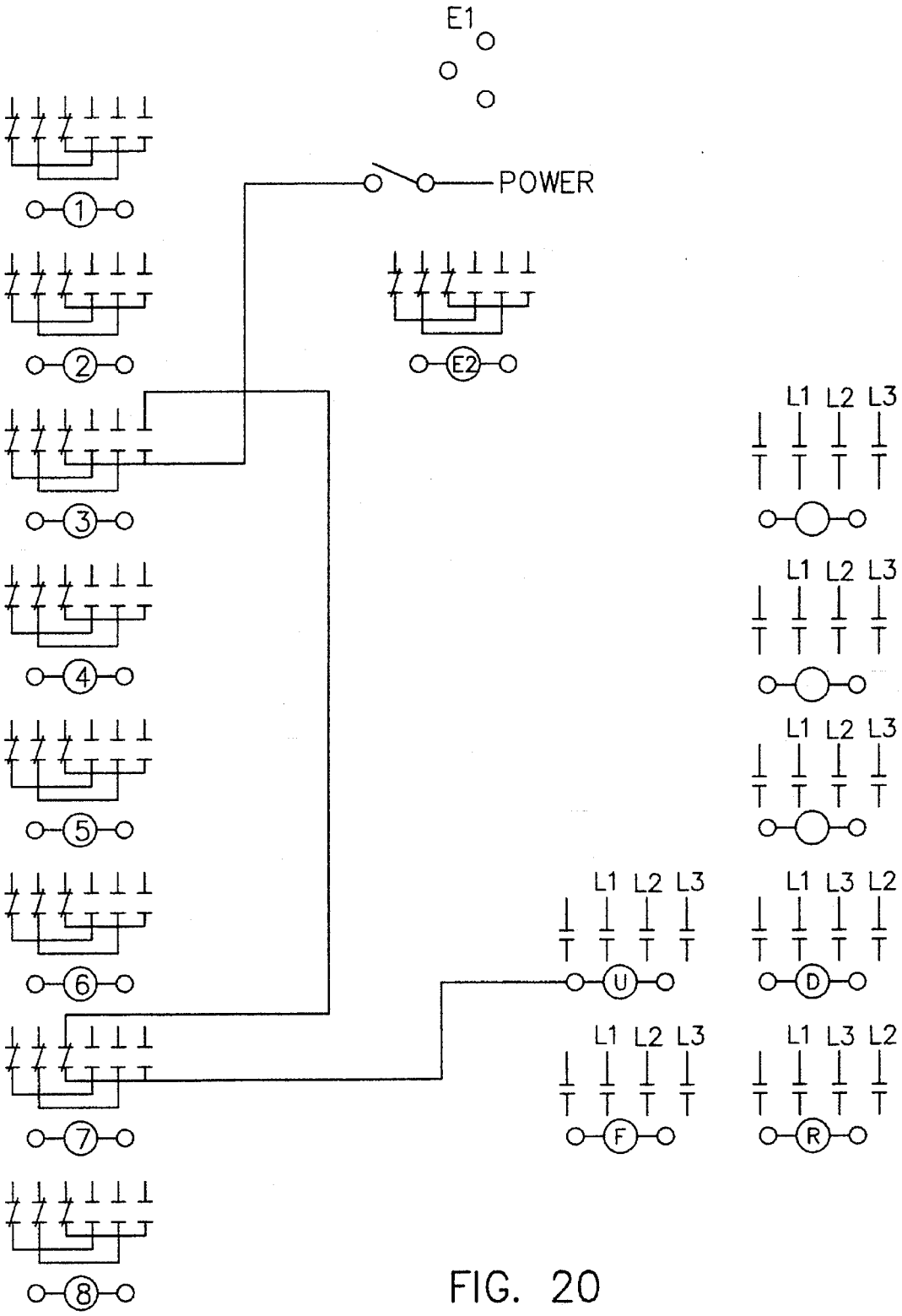

Upward movement to limit switch #7 is depicted in FIG. 20 wherein power starts at limit switch #3 normally open contact and goes to limit switch #7 normally closed contact, and then to coil (U) on the up magnetic starter.

Figure 21:
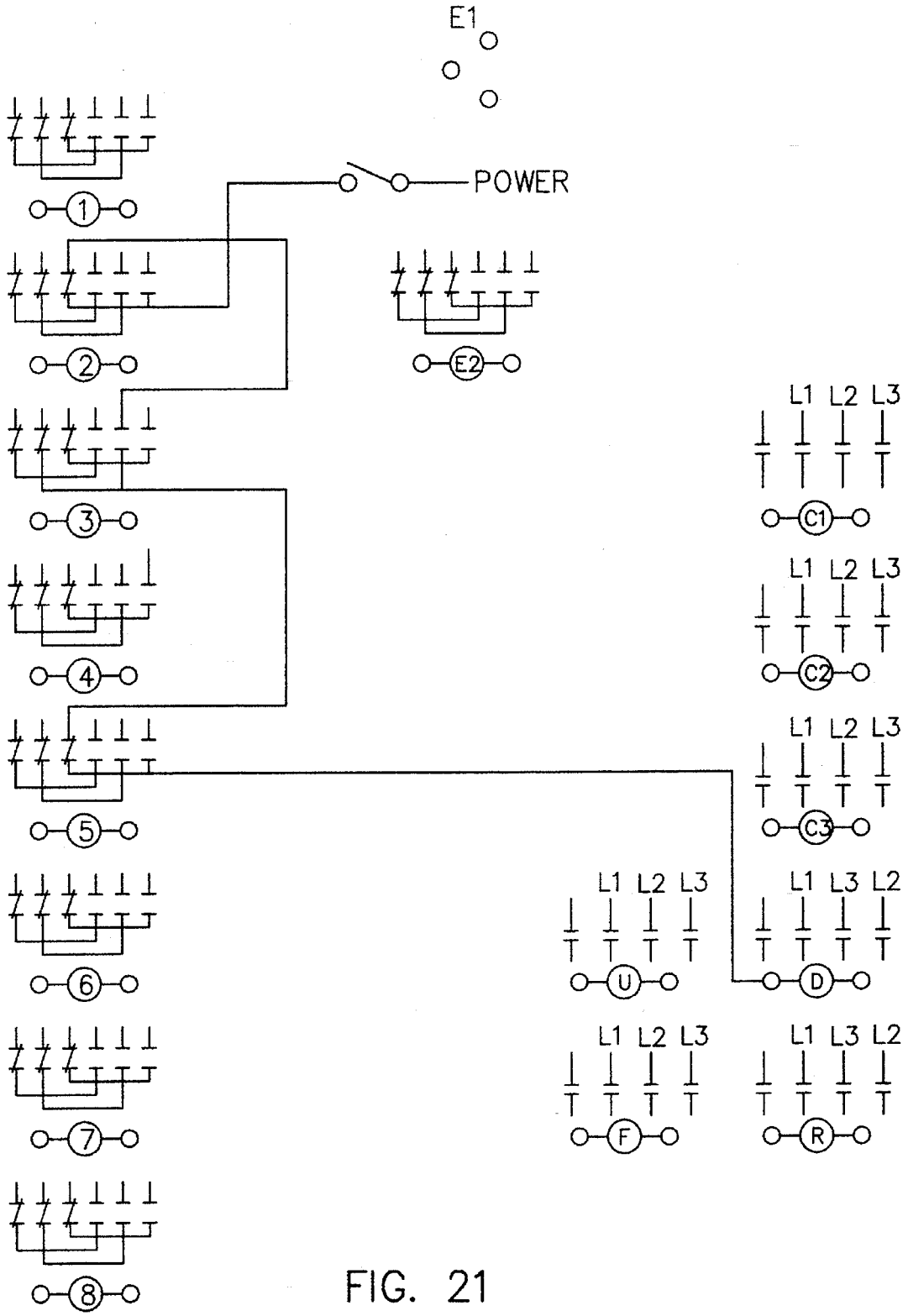

Downward movement is depicted in FIG. 21 wherein power starts at limit switch #2 normally closed contact, then proceeds to limit switch #3 normally open contact, then to limit switch #5 normally closed contact, and finally to the coil (D) on the down magnetic starter.

Figure 22:
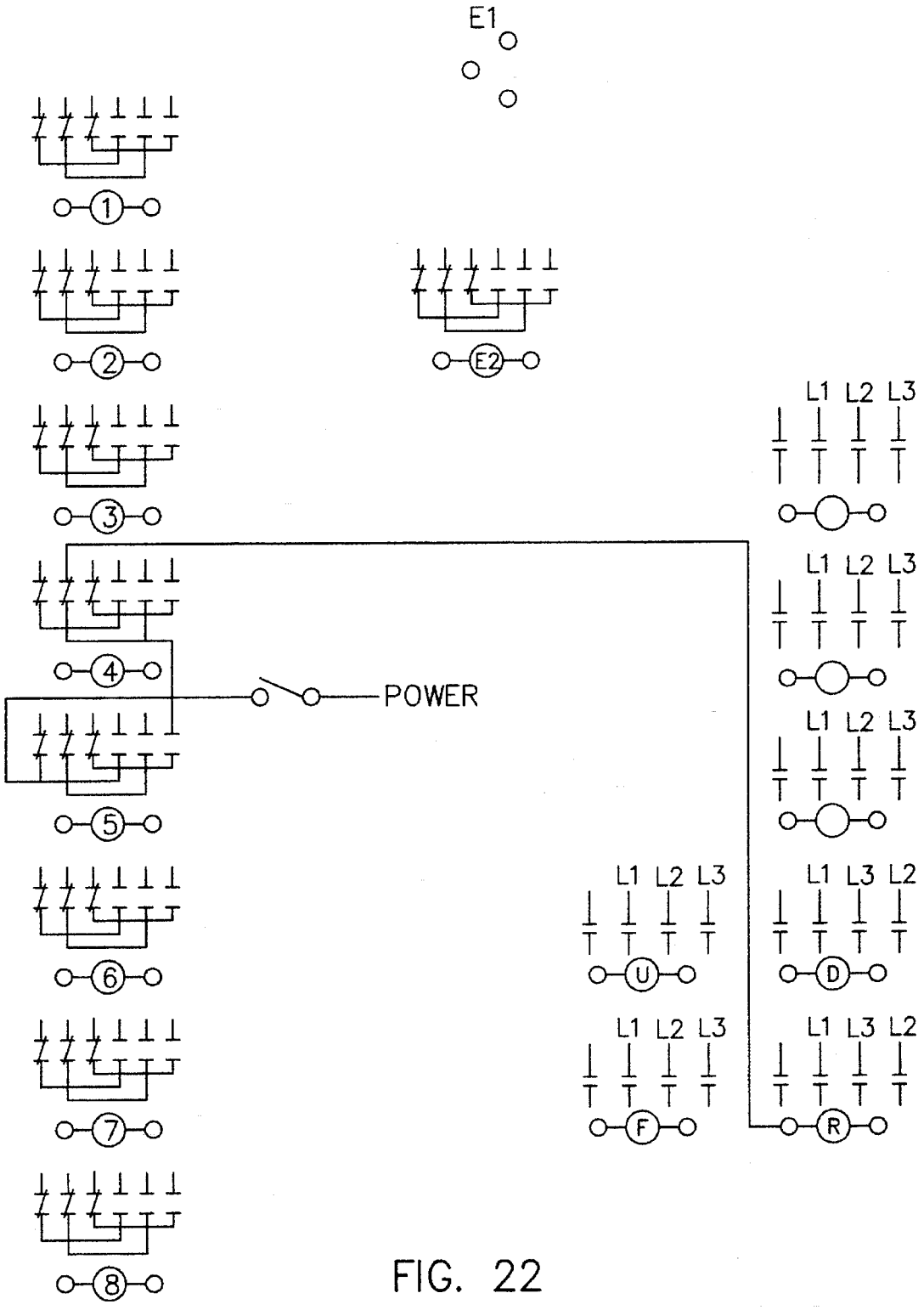

Reverse movement is depicted in FIG. 22 wherein power starts at limit switch #5 normally open contact, and advances to limit switch #4 normally closed contact, then to the coil (R) on the reverse magnetic starter.

Figure 23:
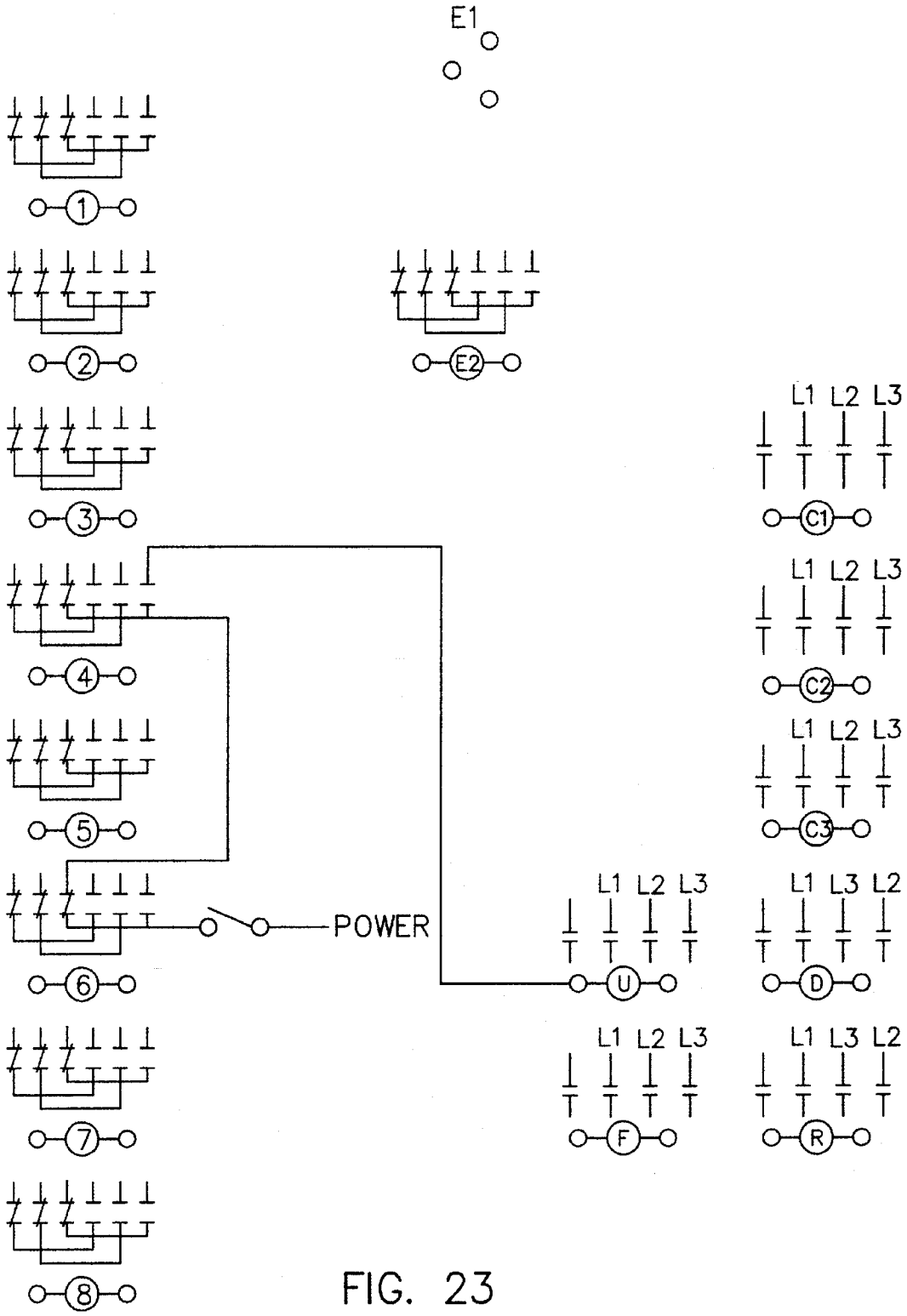

Upward movement to limit switch #6 is depicted in FIG. 23 wherein power starts at limit switch #6 normally closed contact, and then proceeds to limit switch #4 normally open contact, and finally to the coil (U) on the up magnetic starter.

Figure 24:
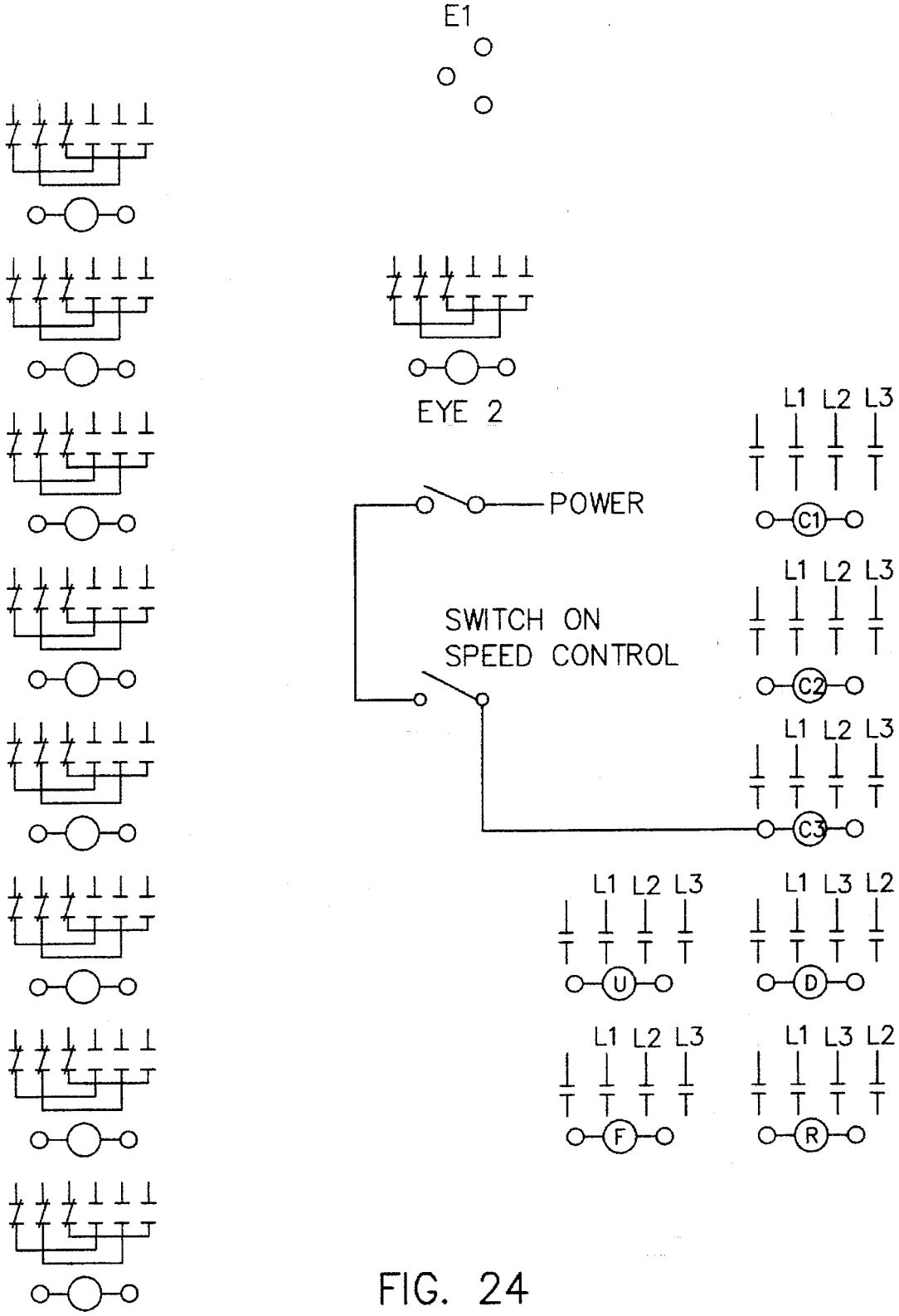
FIG. 24 is the electronic control schematic control of general element 12 of FIG. 2.

Crate conveyor 12 of general element 6, the unloading damper head, is controlled with a switch on the control panel mounted on framework 13. Crate conveyor 12 runs continuously. The only time it is stopped is when there are no onions, or when someone needs to take a break. It must be turned off manually by hand. Said crate conveyor 12 has a speed control on it as shown in FIG. 24 so that crate 7 can be accelerated or slowed down as needed for optimum onion flow.

Figure 25:
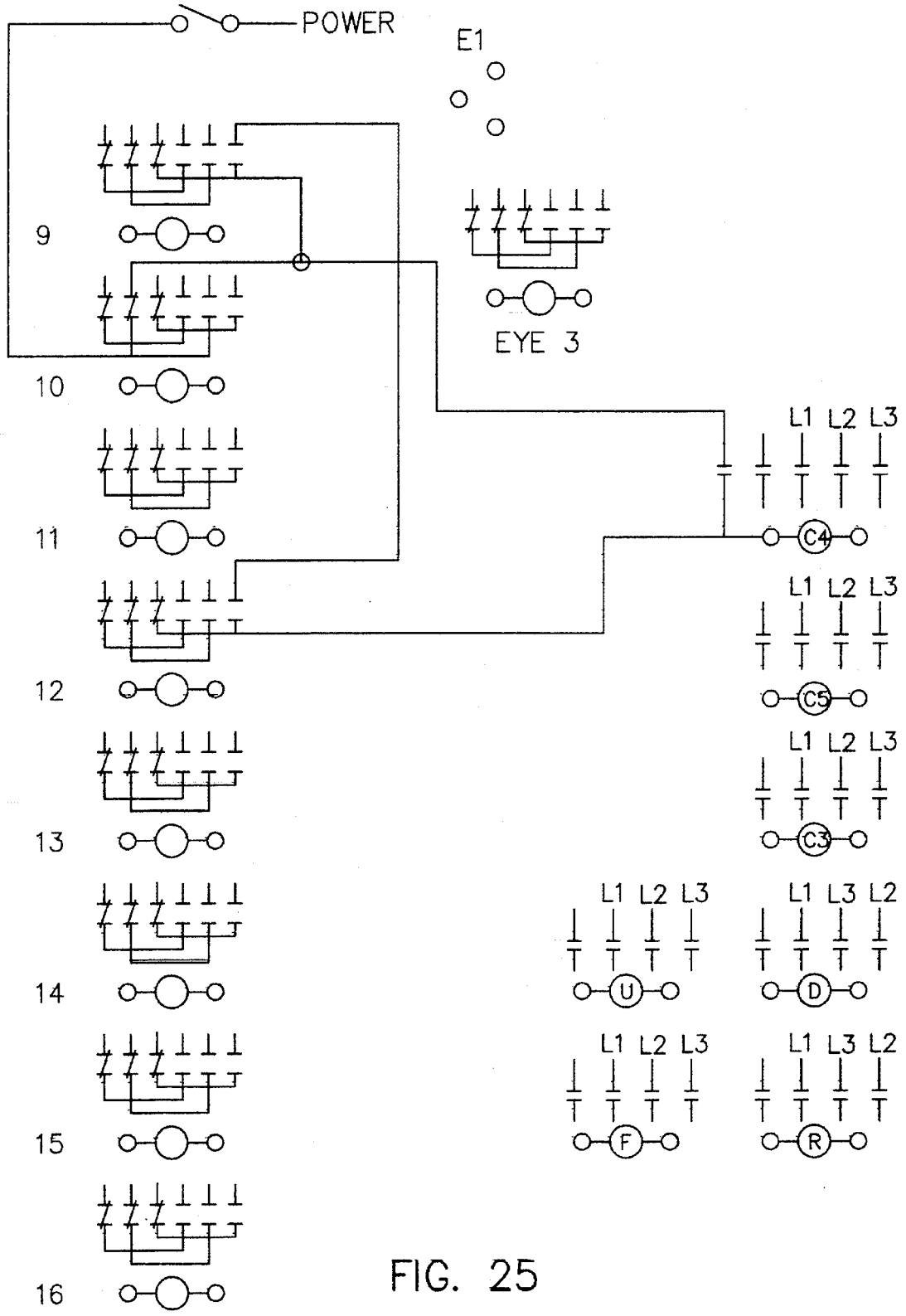
FIGS. 25 and 26 are the electronic schematic control of general element 10 of FIG. 2.
Figure 26:
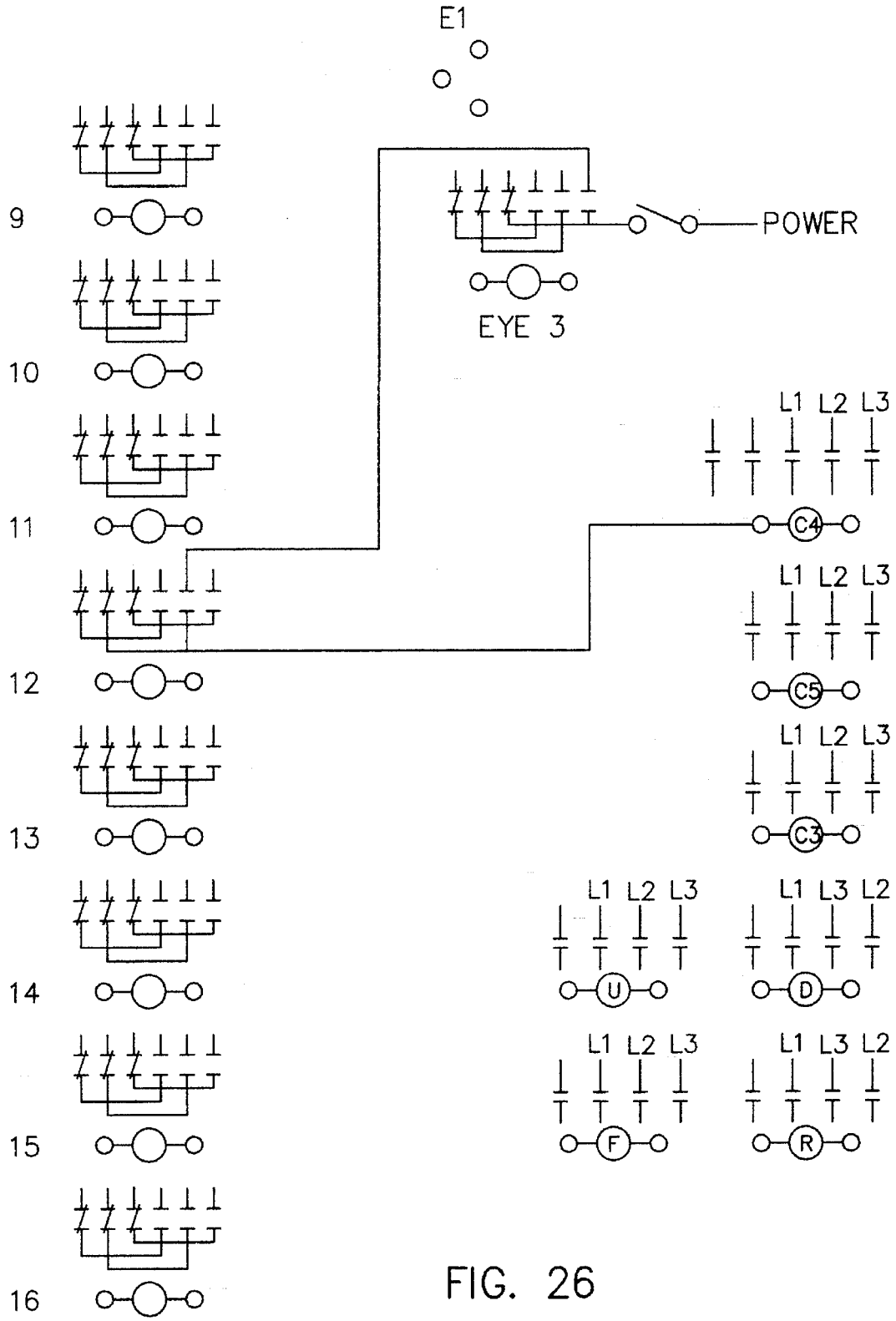

The crate conveyor which accompanies full crate hoist 10 of FIG. 2 is controlled in two ways. One is when a crate 7 comes from crate conveyor 12, and the other is when the stack of two full crates need to be moved to crate conveyor 11 of said FIG. 2. When crate 7 comes from crate conveyor 12 as shown in FIG. 25, power starts at limit switch #10 normally closed contact, and proceeds to limit switch #9 normally open contact and to crate conveyor of full crate hoist 10 (C4) normally open contact which is a holding contact for the magnetic starter, then from limit switch #9 normally open contact to limit switch #12 (12) normally open contact, then to the coil (C4) on the magnetic starter of said crate conveyor of full crate hoist 10. When the stack of two full crates need to be moved as depicted in FIG. 26, power starts at eye #3 normally open contact, then proceeds to limit switch #12 normally open contact, and then to the coil (C4) on the magnetic starter of said crate conveyor associated with full crate hoist 10.

Figure 27:
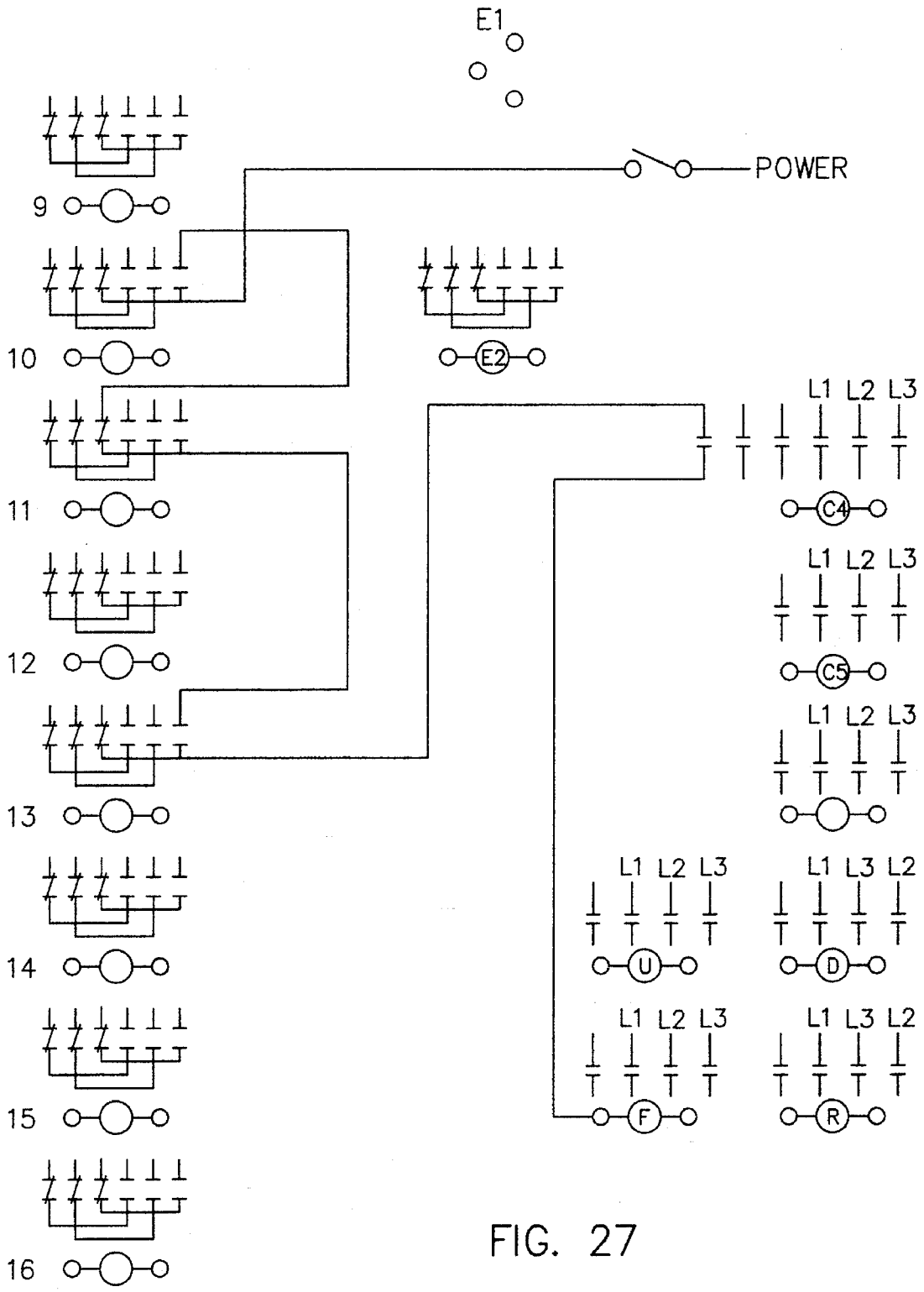
FIGS. 27 through 31 are the electronic control schematic for the stacking of general element 10 of FIG. 2.

Control for the fork and carriage assemblies associated with general element 10 of FIG. 2 is substantially similar to that of empty crate hoist 8 of said FIG. 2. There are five ways to control the fork and carriage assemblies. These are: forward to limit switch #11 (11), up to limit switch #15 (15), down to limit switch #14 (14), reverse to limit switch #12 (12), and down to limit switch #13 (13). As depicted in FIG. 27 for carriage forward movement control, power starts at limit switch #10 (10) normally open contact and proceeds to limit switch #11 (11) normally closed contact, then to limit switch #13 normally open contact, then to crate conveyor associated with general element 10 (C4) magnetic starter coil normally open contact, then to coil (F) on the forward magnetic starter.

Figure 28:
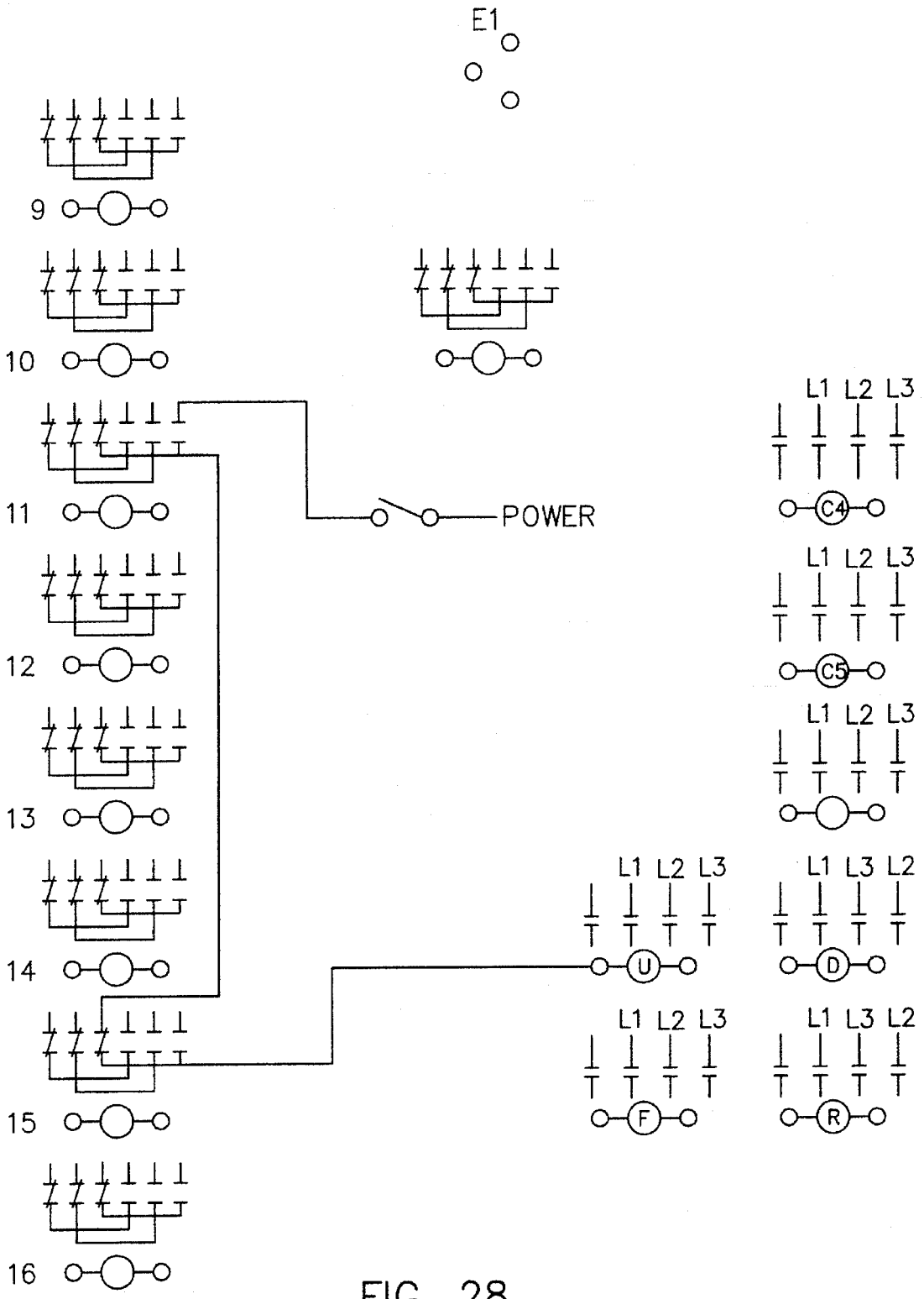

Upward movement to limit switch #15 is depicted in FIG. 28 wherein power starts at limit switch #11 normally open contact and proceeds to limit switch #15 normally closed contact, then to coil (U) on the upward magnetic starter.

Figure 29:
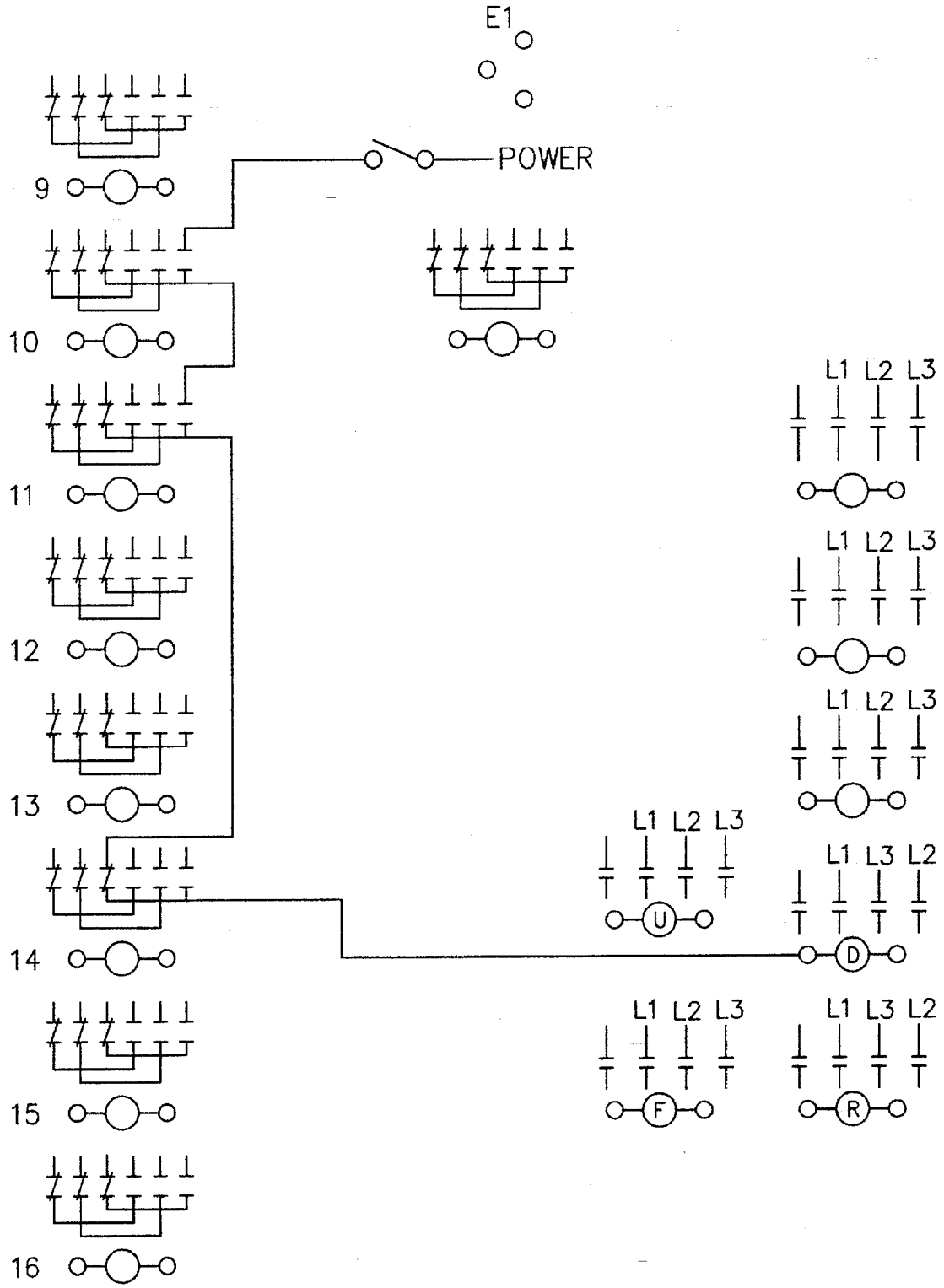
Figure 30:
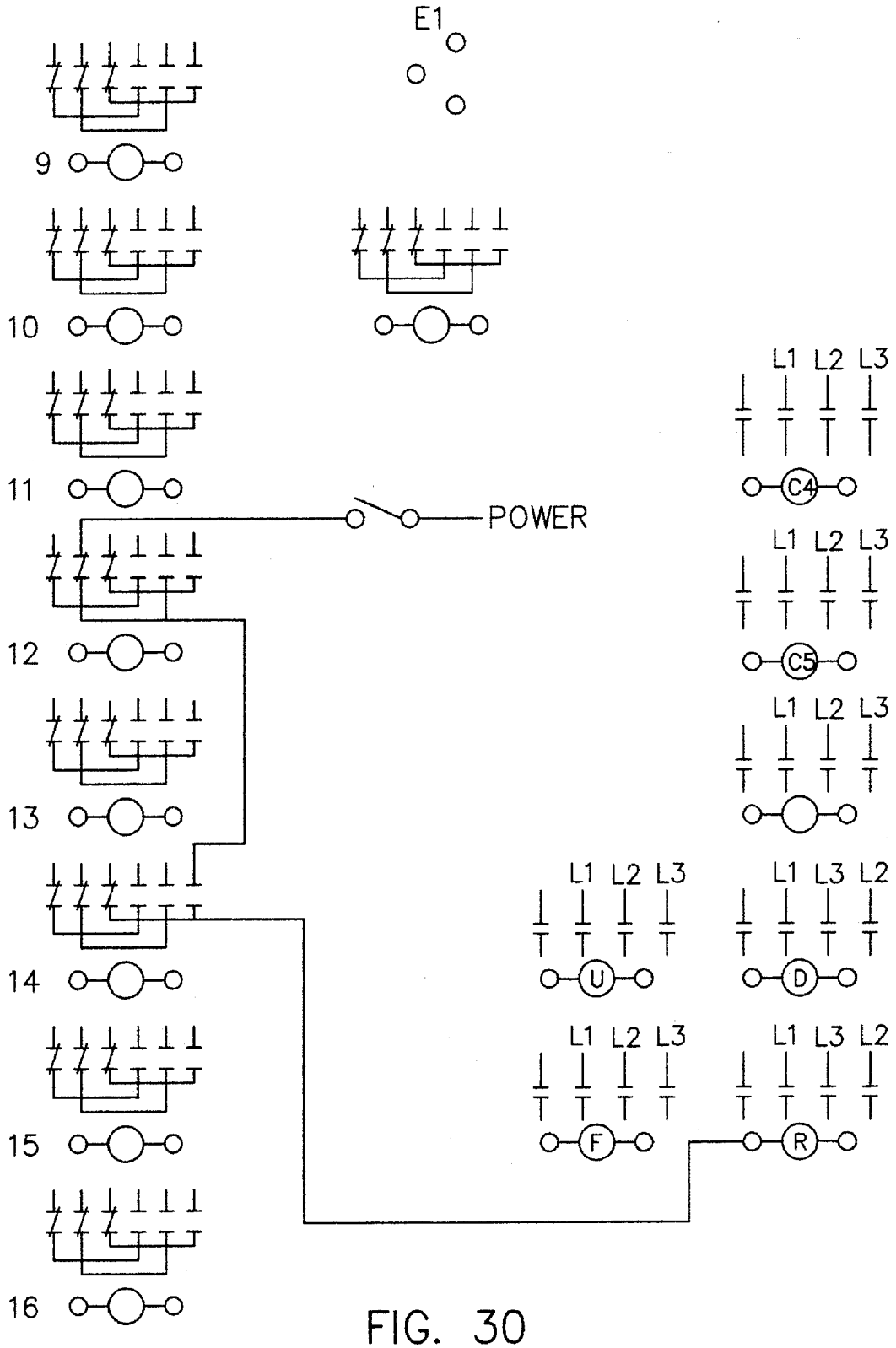

Downward movement to limit switch #14 is depicted in FIG. 29 wherein power starts at limit switch #10 normally open contact and proceeds to limit switch #11 normally open contact, then to limit switch #14 normally closed contact, then to the coil (D) on the down magnetic starter. Reverse movement is depicted in FIG. 30 wherein power starts at limit switch #12 (12) normally closed contact and proceeds to limit switch #14 normally open contact, and then to the coil (R) on the reverse magnetic starter.

Figure 31:
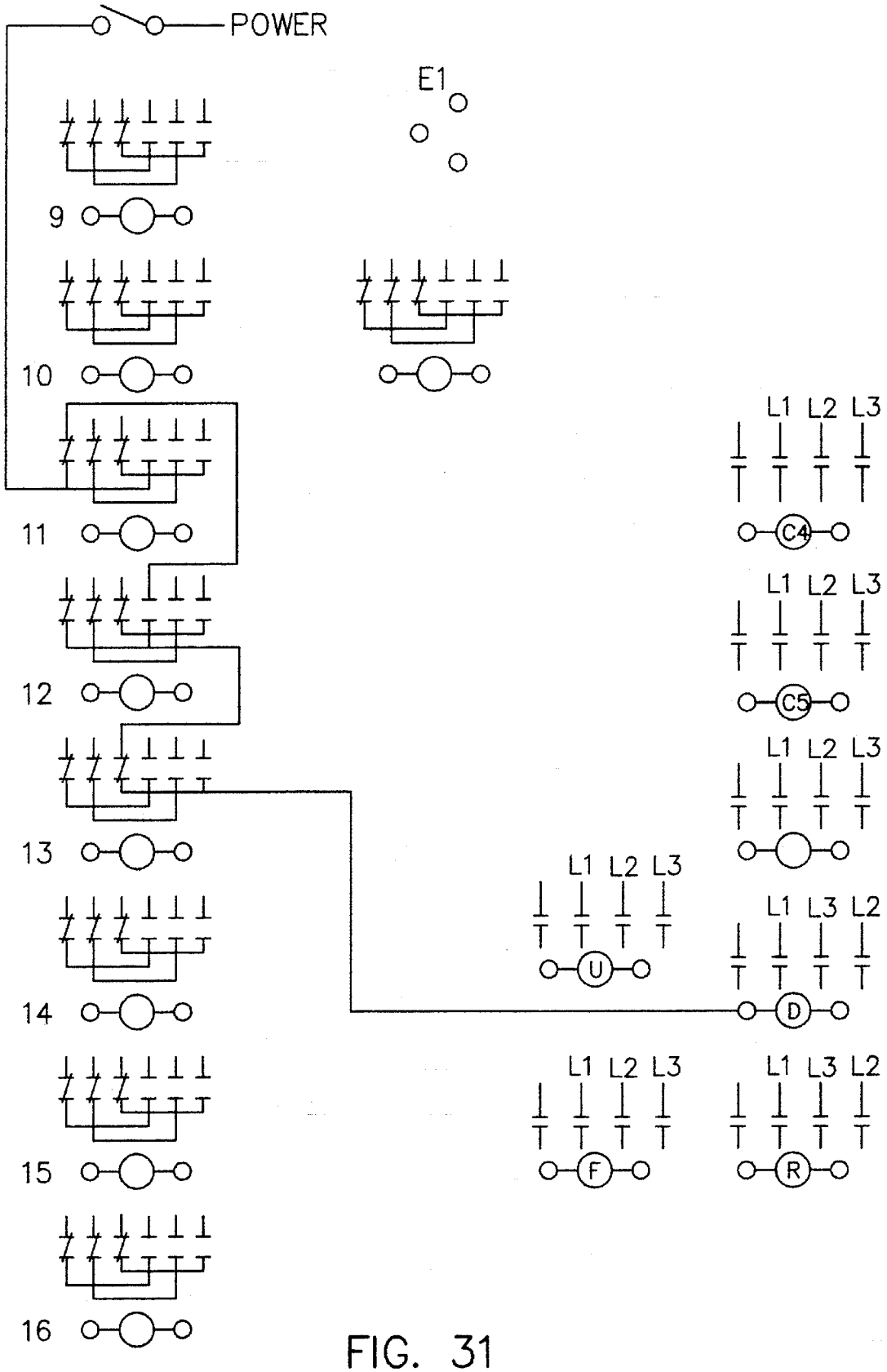

Downward movement to limit switch #13 is depicted in FIG. 31 wherein power starts at limit switch #11 normally closed contact and proceeds to limit switch #12 normally open contact, then to limit switch #13 normally closed contact, and then to the coil (D) on the down magnetic starter.

Figure 32:
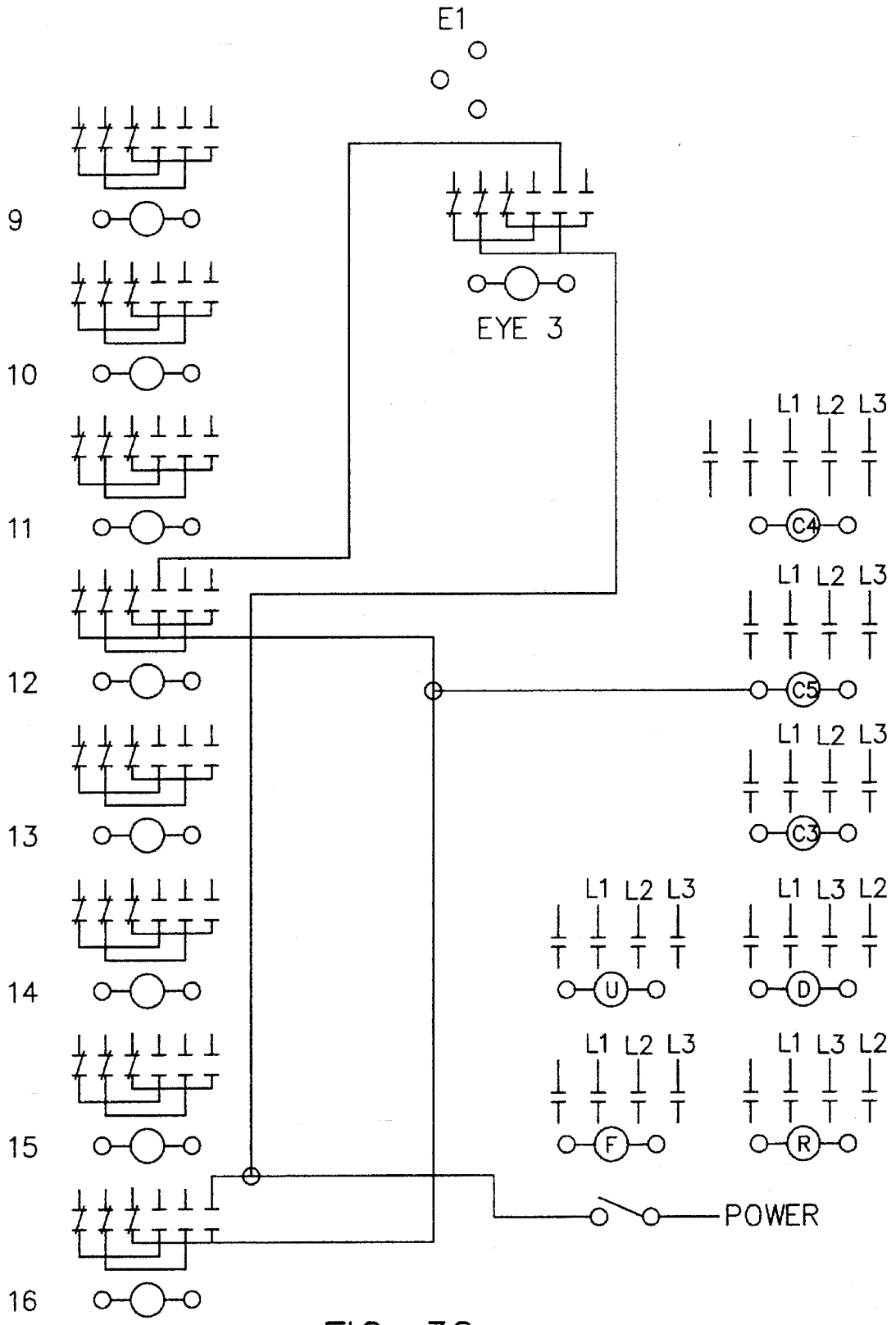
FIG. 32 is the electronic control schematic of general element 11 of FIG. 2.

Crate conveyor 11 of FIG. 2 receives full and stacked crates from general element 10 of said FIG. 2. Crate conveyor 11 is electronically controlled from two places. As depicted in FIG. 32, power starts at eye #3 normally open contact and proceeds to limit switch #12 normally open contact, then to the coil (C5) n conveyor 11 magnetic starter. There is also power on limit switch #6 normally open contact to coil (C5) on the conveyor 11 magnetic starter. Eye #3 and limit switch #12 will start crate conveyor 11. Stacked crate 7 will then move and trip limit switch #16 (16). When the stacked crate 7 leaves crate conveyor associated with general element 10 of FIG. 2, limit switch #12 will open, but with limit switch #16 tripped, conveyor 11 will run until the said crates move far enough to let limit switch #16 go back to its normal position, and as a result, will stop conveyor 11.

Figure 33:
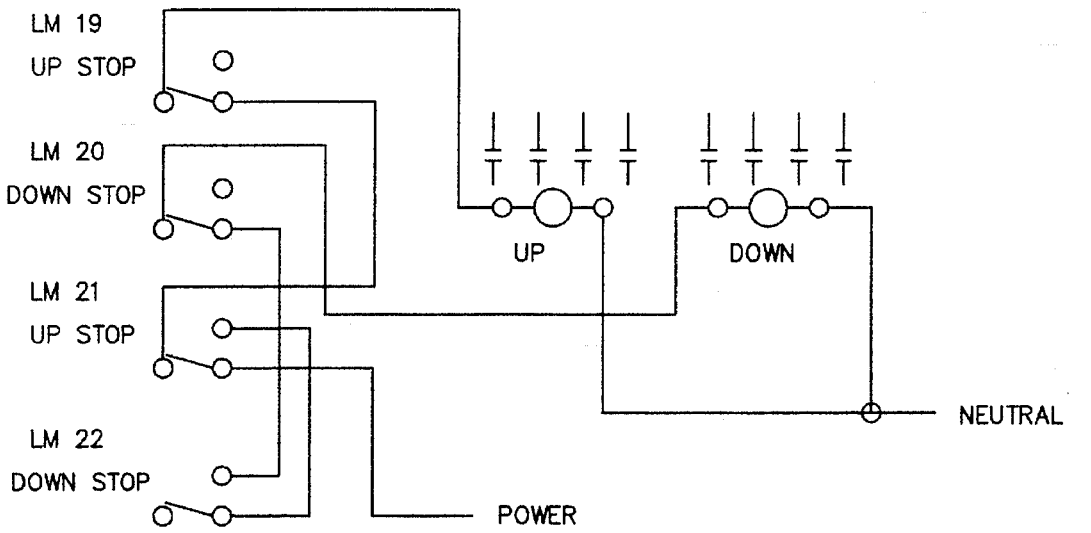
FIG. 33 is the electronic control schematic of general element 6 of FIG. 2.
Figure 33:
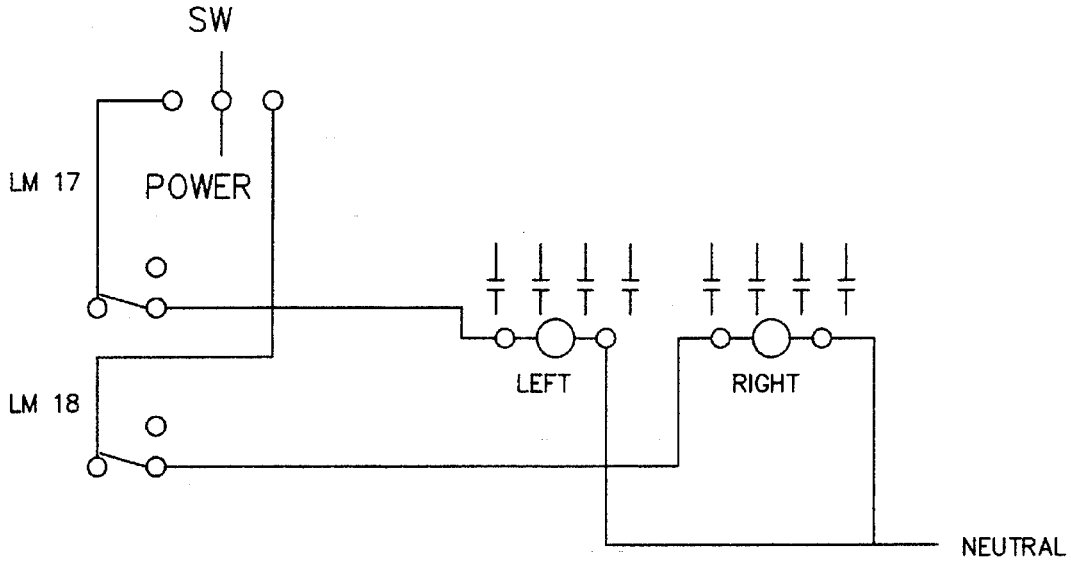

The control of general element 6 is accomplished by two motors as shown in FIG. 33. One which controls the diverter dam 15 which in turn diverts onions either in the crate that is starting to fill, or the crate that is completing its fill. The second motor moves the damper assembly 16 of FIG. 3 up and down to cushion the onions when a crate is starting to fill. Diverter dam 15 control is accomplished with a switch on the control panel. The switch has an off center position. Turn the switch left, and diverter dam 15 will go left until it trips limit switch 17. Turn the switch right, and diverter dam 15 will go right until it trips limit switch 18. The switch is spring loaded to always go to the off position, so it has to be held in position to move the said diverter dam.

Figure 5:
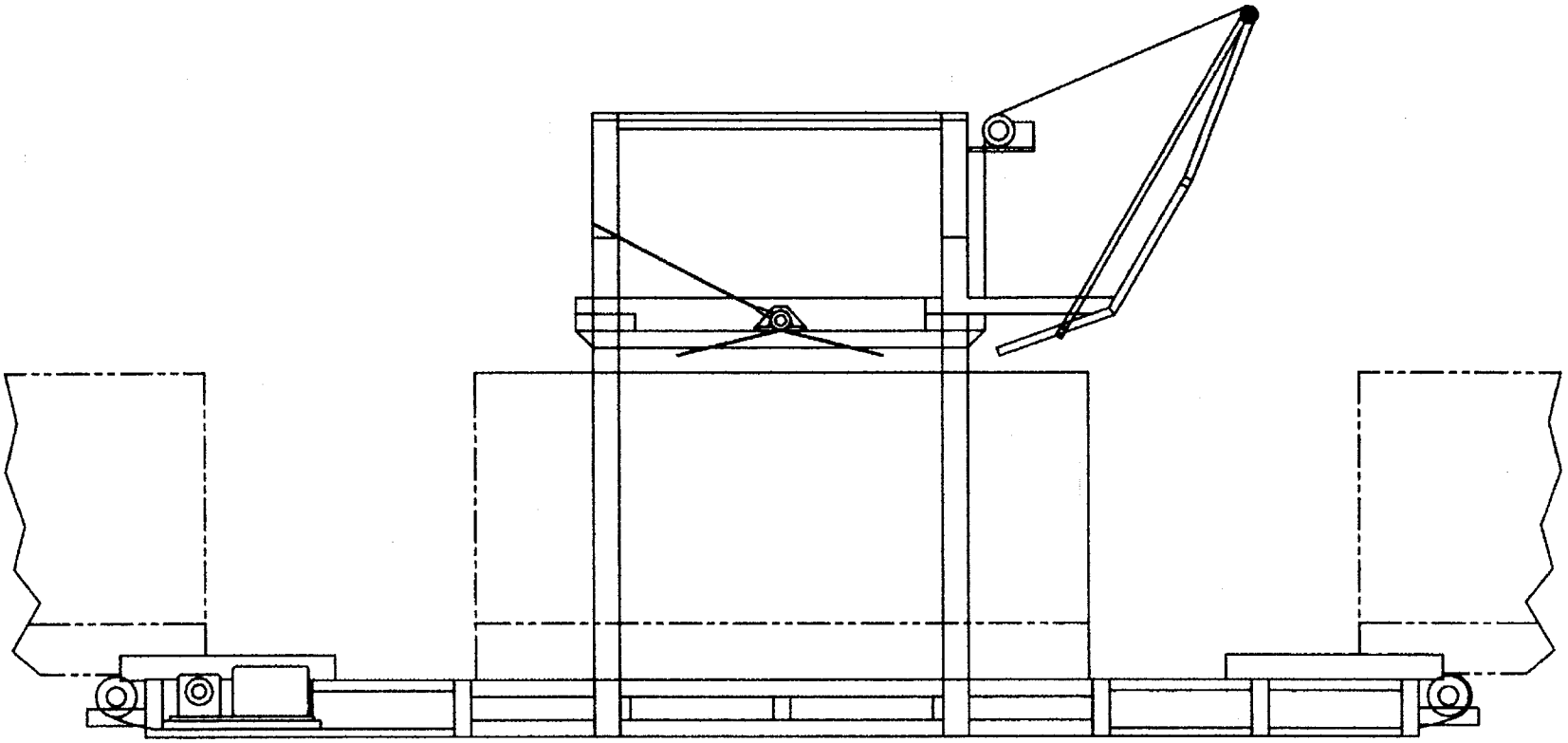
FIG. 5 is a view of the device of FIG. 3 in its retracted state.

Damper assembly 16 control is accomplished with power starting at limit switch #21 and proceeding through the normally closed contact to limit switch 19, then through the normally closed contact to the up coil. The down stroke is completed by getting power from limit switch #21 normally open contact to limit switch #22 normally open contact, then to limit switch #20 normally closed contact, then to the down coil. When no crates are present, damper assembly 16 is always in the up position as shown in FIG. 5.

While the onion loader/unloader conveyor system has been shown and described in detail, it is obvious that this invention is not to be considered as being limited to the exact form disclosed, and that changes in detail and construction may be made therein within the scope of the invention, without departing from the spirit thereof.

Having thus set forth and disclosed the nature of this invention, what is claimed is:

1. An onion loading/unloading conveyor system, said system comprising:

a. a multi-head collection scoop with each head comprising a scoop which accumulates onions and disperse them onto a sub-conveyor, b. said sub-conveyor discharging its onions onto a main conveyor as controlled by a diverter dam, c. said main conveyor discharging onions into an unloading damper head with entry controlled by a diverter dam to direct onions to a crate beginning its fill or to a crate completing its fill of onions, d. said crate having come by conveyor from an empty crate hoist which releases a single empty crate at a time, and leaving said unloading damper head after completing its fill of onions, e. said empty crate hoist receiving empty stacked crates from an empty crate holding conveyor, f. said full onion crate leaving said unloading damper head and advancing to a full crate hoist which stacks two full crates of onions and advances said stacked full crates to a holding conveyor to await transportation by forklift to storage area.

2. A system as defined in claim 1, wherein said unloading damper head comprises a crate conveyor at substantial length to hold two crates side by side, with said crate conveyor attached to a frame stand, which frame stand supports a pivotal diverter dam housed within an enclosure.

3. A device as defined in claim 2, wherein said enclosure comprises a diverter dam which pivots about its attachment located at the middle of said enclosure and which diverter dam activates a limit switch.

4. A device as defined in claim 2, wherein said frame stand supports a vertical mobile damper assembly which damper assembly is aligned in its vertical motion by sliding a round bar of said mobile damper assembly within linear bearings, and which vertical mobile damper assembly is activated in its motion by limit switches.

5. A device as defined in claim 2, wherein said frame stand supports a motor driven drum located substantially above a vertical mobile damper assembly and said drum driving a cable passing through a single pulley and attaching to said mobile damper assembly.

6. A device as defined in claim 4, wherein said vertical mobile damper assembly comprises a substantially sloped rubber pad attached to a frame work of said vertical mobile damper assembly.

7. A device as defined in claim 1, wherein said empty crate hoist comprises a cable assembly, a fork assembly attached to said cable assembly, a carriage assembly, a carriage support frame, and a crate conveyor.

8. A device as defined in claim 7, wherein said fork assembly comprises two forks attached to a support frame, and said support frame providing mounts for four cam rollers located at the four corners of said support frame.

9. A device as defined in claim 7, wherein said carriage assembly comprises two vertical channels held in place by a framework and spaced so as to provide tracking for said fork assembly, mounting brackets for said cable assembly, and four cam rollers located at the four corners of the framework base.

10. A device as defined in claim 7, wherein said cable assembly comprises two sheaves, one motor driven cable drum, and a cable forming a continuous loop and interconnecting all three said components and attaching to the fork assembly.

11. A device as defined in claim 7, wherein said carriage support frame comprises a two horizontal and substantially long channels spaced so as to provide tracking for four carriage assembly cam rollers, a motor driven cable drum, a sheave located at the opposite end of said cable drum, and a cable interconnecting said sheave and cable drum, and whose ends attach to the carriage assembly.

12. A device as defined in claim 7, wherein said crate conveyor is attached to the two channels of said carriage support frame.

* * * * *